US010160218B2

(12) United States Patent
Kudo et al.

(10) Patent No.: US 10,160,218 B2
(45) Date of Patent: Dec. 25, 2018

(54) PRINTER

(71) Applicant: SEIKO EPSON CORPORATION, Tokyo (JP)

(72) Inventors: Shoma Kudo, Nagano (JP); Naomi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/632,490

(22) Filed: Jun. 26, 2017

(65) Prior Publication Data

US 2017/0368832 A1 Dec. 28, 2017

(30) Foreign Application Priority Data

Jun. 28, 2016 (JP) ..... 2016-127303
Jul. 13, 2016 (JP) ..... 2016-138249

(51) Int. Cl.
*B41J 2/175* (2006.01)

(52) U.S. Cl.
CPC ..... *B41J 2/17503* (2013.01)

(58) Field of Classification Search
CPC ..... B41J 2/17503
See application file for complete search history.

(56) References Cited

U.S. PATENT DOCUMENTS

| | | | | |
|---|---|---|---|---|
| 9,586,407 | B2 | 3/2017 | Kimura et al. | |
| 2016/0052286 | A1 | 2/2016 | Kimura et al. | |
| 2016/0243619 | A1* | 8/2016 | Gothait | C09D 11/30 |
| 2017/0129246 | A1 | 5/2017 | Kimura et al. | |

FOREIGN PATENT DOCUMENTS

| | | | |
|---|---|---|---|
| JP | 2015-131434 | A | 7/2015 |
| JP | 2015-139919 | A | 8/2015 |

* cited by examiner

*Primary Examiner* — Lamson Nguyen

(57) ABSTRACT

For printers there are issues relating to consideration to be given to heat sources. A printer is provided with a printhead capable of executing printing on a printing medium by jetting an ink onto the printing medium, a tank having an ink container portion capable of containing ink to be supplied to the printhead, and a heat source. A low thermal conductance part that reduces thermal conductance is positioned between the heat source and the ink container portion.

11 Claims, 21 Drawing Sheets

PRINTER

CROSS REFERENCE TO RELATED APPLICATIONS

The present application claims priority from Japanese Patent Application No. 2016-127303 filed on Jun. 28, 2016, Japanese Patent Application No. 2016-138249 filed on Jul. 13, 2016, the contents of which are hereby incorporated by reference into this application.

BACKGROUND

1. Technical Field

The present invention relates to printers and the like.

2. Related Art

Inkjet printers have long been known as one example of printers. Inkjet printers are able to carry out printing onto a printing medium by jetting an ink, which is one example of a liquid, from a printhead onto a printing medium such as a printing sheet. Usually in inkjet printers such as these, a configuration is known in which ink from an ink tank is supplied to the printhead (for example, JP-A-2015-139919).

JP-A-2015-139919 is an example of related art.

In the above-mentioned printers, various power sources such as motors are installed in structural units that carry out printing on the printing medium. Generally, heat is produced accompanying the operation of these power sources such as motors. For this reason, power sources such as motors can also become heat sources. On the other hand, there is an ever increasing demand for greater compactness in printers. Accompanying this greater compactness in printers, there is a higher importance for the consideration given to the structural components that are heat sources. In this way, there are issues for printers relating to the consideration given to heat sources.

SUMMARY

An advantage of some aspects of the invention is in addressing at least some of these issues and can be achieved as any of the following embodiments or applied examples.

Application Example 1

A printer is provided with a printhead capable of executing printing on a printing medium by jetting an ink onto the printing medium, a tank having an ink container portion capable of containing ink to be supplied to the printhead, and a heat source, wherein a low thermal conductance part that reduces thermal conductance is positioned is positioned between the heat source and the ink container portion.

In the printer, a low thermal conductance part is positioned between the heat sources and the ink container portions, and therefore the conveyance of heat from the heat sources to the ink within the ink container portions can be kept low. In this way, a printer can be provided that gives consideration to the effect of heat sources on the ink inside the ink container portions.

Application Example 2

In the above printer, the low thermal conductance part is a space formation unit that demarcates a space.

In the printer, a space can be provided between the heat sources and the ink container portions by a space formation unit, and therefore the conveyance of heat from the heat sources to the ink within the ink container portions can be kept low by the space.

Application Example 3

In the above printer, the space formation unit is provided outside the tank.

In this printer, the space formation unit is provided outside the tank, and therefore it is easier to avoid increasing the size of the tank.

Application Example 4

In the above printer, the space formation unit is provided inside the tank.

In the printer, the space formation unit is provided inside the tank, and therefore it is possible to integrate the tank and the space formation unit.

Application Example 5

In the above printer, a wall that demarcates the ink container portion provides the low thermal conductance part.

In the printer, conveyance of heat from the heat sources to the ink within the ink container portions can be kept low by a wall that demarcates the ink container portion.

Application Example 6

In the above printer, the low thermal conductance part includes a heat insulating member.

In the printer, the low thermal conductance part includes a heat insulating member, and therefore conveyance of heat from the heat sources to the ink within the ink container portions can be kept even further lower.

Application Example 7

In the above printer, an ink flow channel when ink inside the ink container portion is supplied to the printhead passes through the space formation unit.

In the printer, the space inside the space formation unit can be cooled by the flow of ink in the ink flow channels.

Application Example 8

In the above printer, when the printer is viewed from a front surface in a usage position of the printer, the ink container portion and the space formation unit are arranged within a rectangular region, the heat source is positioned outside the rectangular region and positioned further upward than the ink container portion, the space formation unit is positioned above the ink container portion, an ink inlet portion capable of inletting ink into the ink container portion is formed in the ink container portion, the ink inlet portion is formed in an upper portion of the ink container portion and positioned on an opposite side of the heat source side from the space formation unit.

In the printer, the ink inlet portion is positioned sandwiching the space formation unit on an opposite side from the heat source side, and therefore the conveyance of heat from the heat sources to the ink being injected into the ink inlet portion can be kept low.

Application Example 9

In the above printer, an information display unit capable of displaying information, wherein the heat source is the information display unit.

In the printer, conveyance of heat from the information display device, which is a heat source, to the ink within the ink container portions can be kept low.

Application Example 10

In the above printer, when viewing the printer from a planar view, the ink container portion, the low thermal conductance part, and the heat source are positioned in a front-back direction.

Generally in printers, it is common for heat sources such as motors to be installed at the rear surface side. For this reason, as in this example, by arranging the ink container portions at the front surface side, the low thermal conductance part is more easily arranged between the ink container portions and the heat sources, and therefore increases in size can be suppressed.

Application Example 11

In the above printer, when viewing the printer from a planar view, the heat source, the low thermal conductance part, and the ink container portion are positioned in a left-right direction that intersects the front-back direction.

In the printer, the heat sources, the low thermal conductance parts, and the ink container portions are easily arranged, and therefore increases in size can be suppressed.

Application Example 12

In the above printer, when viewing the printer from a front surface in a usage position of the printer, the heat source, the low thermal conductance part, and the ink container portion are positioned in a vertical direction.

In the printer, the heat sources, the low thermal conductance parts, and the ink container portions are easily arranged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
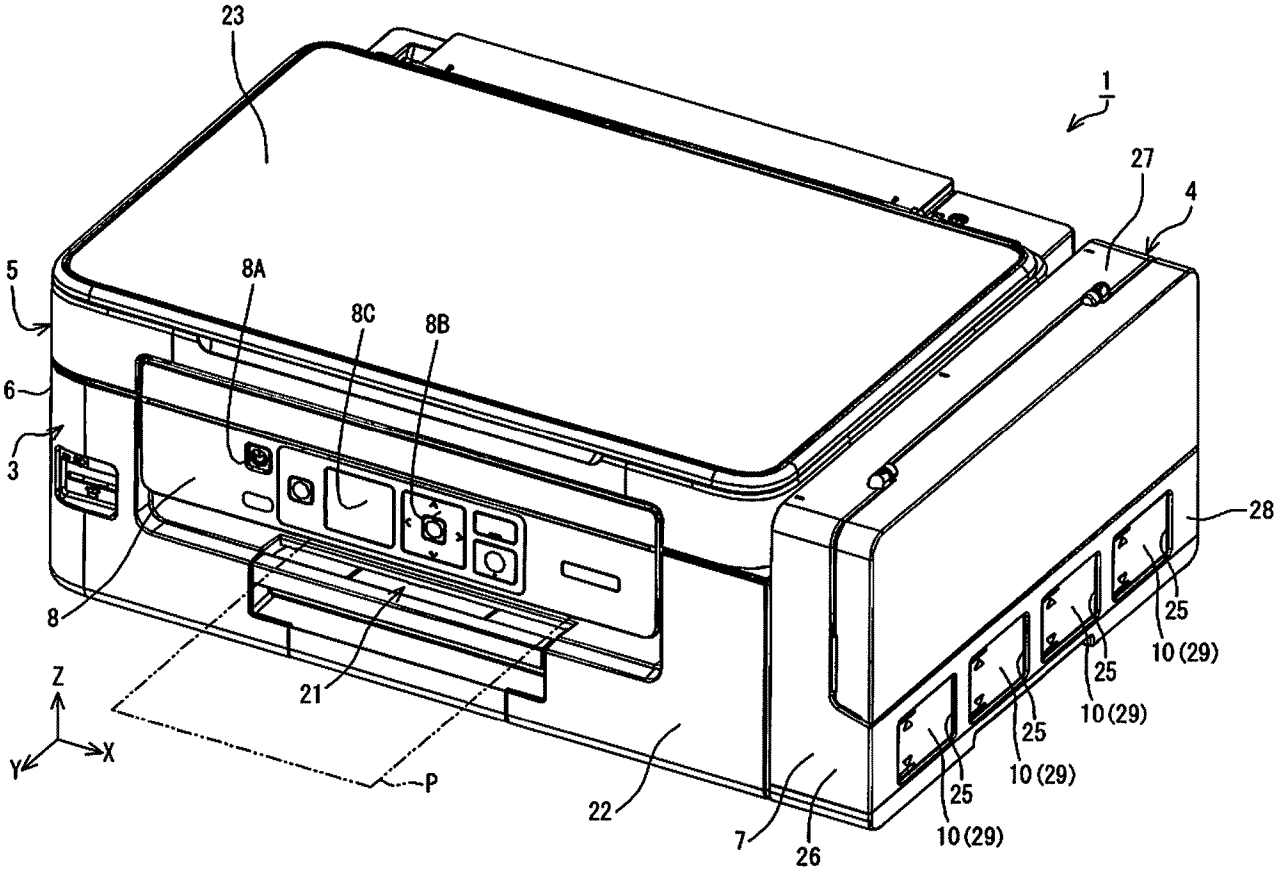
FIG. 1 is a perspective view showing main constituents of a printer according to the present embodiment.

Embodiments of the present invention are described with reference to the accompanying drawings. It should be noted that the scale of the structures and parts in the drawings varies according to the magnitude of the recognizability of the respective structures.

As shown in FIG. 1, a printer 1 according to the present embodiment has a printing unit 3, which is one example of a liquid jetting device, a tank unit 4, which is installed attached to a side of the printing unit 3, and a scanner unit 5. The printing unit 3 has a housing 6. The housing 6 is structured as an outer shell of the printing unit 3. Structural units (to be described later) of the printing unit 3 are contained inside the housing 6. The tank unit 4 has a housing 7 and multiple (two or a number exceeding two) tanks 10. The multiple tanks 10 are contained in the housing 7. Thus, the multiple tanks 10 are installed attached to the printing unit 3. It should be noted that there are four tanks 10 installed in the present embodiment. The housing 6, the housing 7, and the scanner unit 5 are structured as an outer shell of the printer 1. It should be noted that a structure omitting the scanner unit 5 may also be utilized as the printer 1. The printer 1 is able to carry out printing on a printing medium P such as a printing sheet using ink, which is one example of a liquid. The printing medium P is one example of a medium on which printing is performed. It should be noted that the tanks 10 are one example of a liquid container.

The housing 6 includes a panel 8. Components such as a power button 8A, an input button 8B, and a display device 8C are arranged in the panel 8. The input button 8B receives input from an operator. The display device 8C is one example of an information display unit capable of displaying various information. Various display devices can be utilized as the display device 8C including liquid crystal display devices, and organic EL (electro luminescence) display devices and the like for example.

Here, XYZ axes are added to FIG. 1, which are coordinate axes orthogonal to each other. The XYZ axes are also added when necessary to drawings shown hereafter. In this case, the XYZ axes in each drawing correspond to the XYZ axes shown in FIG. 1. In FIG. 1, a state is shown in which the printer 1 is positioned along an XY plane stipulated by the X axis and the Y axis. In the present embodiment, the state when the printer 1 is positioned along the XY plane in a state in which the XY plane aligns with the horizontal plane is the usage state of the printer 1. The position of the printer 1 when the printer 1 is positioned along the XY plane aligned with the horizontal plane is referred to as the usage position of the printer 1.

Hereinafter, cases where the XYZ axes are shown in drawings or descriptions in which structural components or units of the printer 1 are shown signify the XYZ axes of the state in which the structural components or units are assembled (equipped) in the printer 1. Furthermore, positions of each structural component or unit in the usage position of the printer 1 are referred to as the usage position of the respective structural component or unit. Also, hereinafter, in descriptions of the printer 1 or structural components or units or the like thereof, description is given of these in their usage position unless otherwise stated.

The Z axis is an axis that is orthogonal to the XY plane. In the usage state of the printer 1, the Z axis direction is a vertically upward direction. And in the usage state of the printer 1, a −Z axis direction in FIG. 1 is a vertically downward direction. It should be noted that for each of the XYZ axes, the orientation of the arrow indicates a + (positive) direction and the opposite orientation of the orientation of the arrow indicates a − (negative) direction. Also note that the aforementioned four tanks 10 are arranged lined up along the Y axis. Thus, the Y axis direction may be defined as the direction in which the four tanks 10 are arrayed.

A paper discharge unit 21 is provided in the printing unit 3. In the printing unit 3, the printing medium P is discharged from the paper discharge unit 21. In the printing unit 3, the surface on which the paper discharge unit 21 is provided is given as a front surface 22. It should be noted that in the printer 1, the panel 8 is positioned on the front surface 22. The panel 8 faces in the same direction as the front surface 22 (the Y axis direction in the present embodiment). The front surface 22 of the printing unit 3 and a front surface 22 of the scanner unit 5 are arranged on the same plane as each other. That is, the front surface 22 of the printer 1 is inclusive of the front surface 22 of the printing unit 3 and the front surface 22 of the scanner unit 5. Furthermore, the panel 8 and the front surface 22 of the printing unit 3 are positioned on the same plane as each other.

For the printer 1, the surface on the vertically upward orientation of the scanner unit 5 is given as a top surface 23. The tank unit 4 is arranged at a side area that faces in the X axis direction of a side area where the front surface 22 and the top surface 23 intersect. Window units 25 are provided in the housing 7. The window units 25 are provided on a lateral surface 28 that intersects with a front surface 26 and a top surface 27 in the housing 7. Here, the front surface 26 of the tank unit 4 faces in the same direction as the front surface 22 of the printer 1 (the Y axis direction in the present embodiment). The front surface 26 of the tank unit 4 is arranged on the same plane as the front surface 22 of the printer 1. That is, the front surface 26 of the tank unit 4 is arranged on the same plane as the front surface 22 of the printing unit 3. In this way, unevenness between the printing unit 3 and the tank unit 4 can be reduced in the external appearance of the printer 1, and therefore it is possible to reduce the likelihood of collisions with the surrounding environment at times such as when the printer 1 is relocated.

The window units 25 of the tank unit 4 are provided with optical transparency. And the aforementioned four tanks 10 are provided at positions overlapping the window units 25. An ink container portion 29 is provided in each of the tanks 10. Ink is contained in the ink container portion 29 of each of the tanks 10. And the window units 25 are provided at positions overlapping the ink container portions 29 of the tanks 10. Thus, an operator using the printer 1 can visually confirm via the window units 25 the ink container portions 29 of the four tanks 10 through the housing 7. In the present embodiment, the window units 25 are provided as openings formed in the housing 7. The operator can visually confirm the four tanks 10 via the window units 25, which are openings. It should be noted that the window units 25 are not limited to openings and may be configured as an optically transparent member for example.

In the present embodiment, at least one area of a wall of the ink container portion 29 opposing the window unit 25 of each tank 10 has optical transparency. The ink inside each of the ink container portions 29 can be visually confirmed through a position of the ink container portion 29 having optical transparency. Accordingly, the operator is able to visually confirm the amount of ink in each of the ink container portions 29 of the tanks 10 by visually confirming the four tanks 10 via the window units 25. That is, in the tanks 10, at least one area of a position opposing the window units 25 can be utilized as a visual confirmation unit enabling visual confirmation of ink amounts. Accordingly, the operator can visually confirm via the window units 25 the visual confirmation units of the four tanks 10 through the casing 7. It should be noted that it is also possible for all the walls of the ink container portion 29 to have optical transparency. Furthermore, for the tanks 10, it is also possible for all areas of the positions opposing the window units 25 to be utilized as visual confirmation units enabling visual confirmation of ink amounts.

Figure 2:
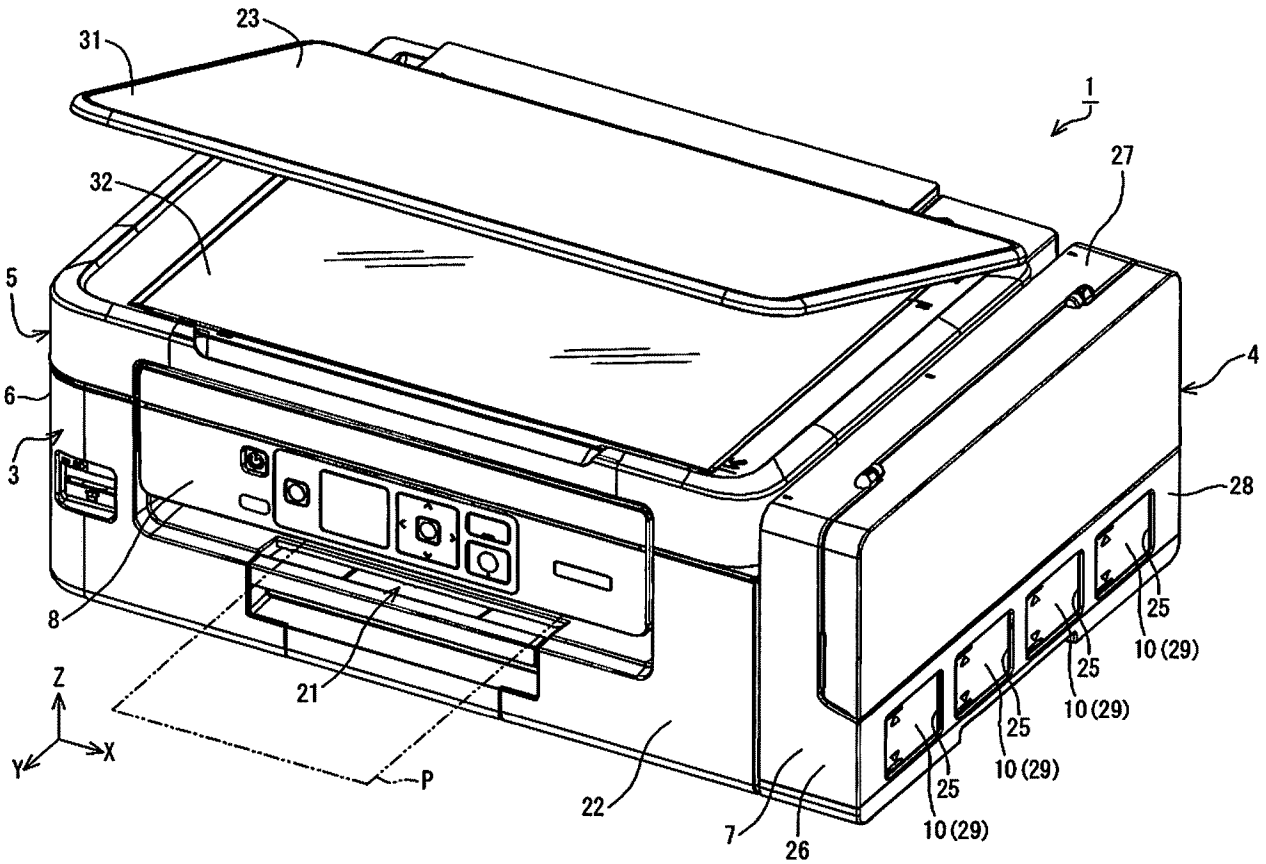
FIG. 2 is a perspective view showing main constituents of a printer according to the present embodiment.

In the printer 1, the printing unit 3 and the scanner unit 5 overlap each other. In a state in which the printing unit 3 is to be used, the scanner unit 5 is positioned vertically above the printing unit 3. The scanner unit 5 is a flatbed type and, as shown in FIG. 2, is provided with an original cover 31 that rotates to enable opening and closing, and an original placement surface 32 that is exposed when the original cover 31 is in an open state. It should be noted that FIG. 2 shows a state in which the original cover 31 is opened. The scanner unit 5 has a capture device (not shown in drawings) such as an image sensor or the like. Through the capture device, the scanner unit 5 is capable of reading as image data an image that is depicted on an original such as a sheet placed on the original placement surface 32. For this reason, the scanner unit 5 functions as a reading device of images and the like.

Figure 3:
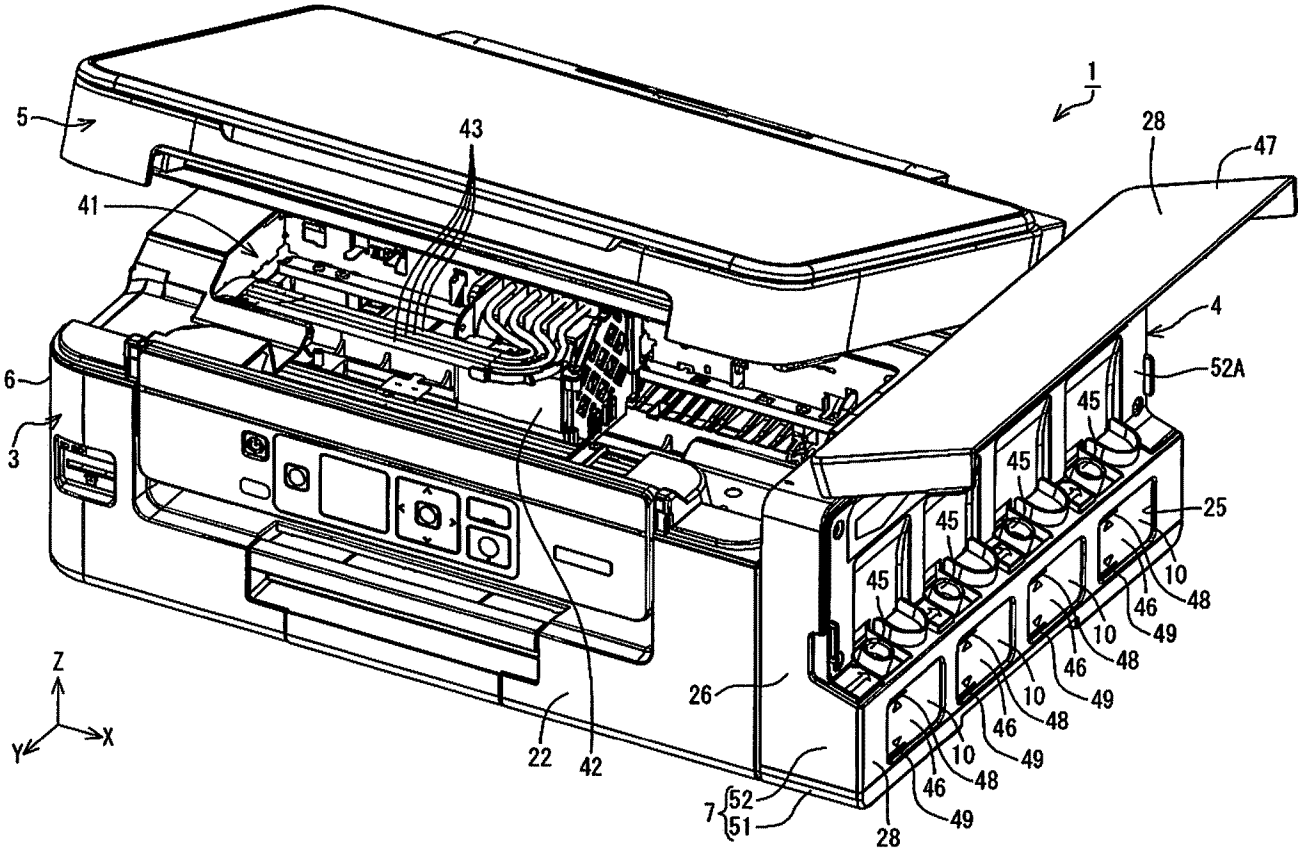
FIG. 3 is a perspective view showing main constituents of a printer according to the present embodiment.

As shown in FIG. 3, the scanner unit 5 is configured to be rotatable on the printing unit 3. The scanner unit 5 also has a function of a lid of the printing unit 3. By lifting the scanner unit 5 in the Z axis direction, the operator can rotate the scanner unit 5 on the printing unit 3. In this way, the scanner unit 5, which functions as a lid of the printing unit 3, can be opened on the printing unit 3. FIG. 3 shows a state in which the scanner unit 5 is open on the printing unit 3.

As shown in FIG. 3, the printing unit 3 has a mechanical unit 41. The mechanical unit 41 has a printing portion 42. In the printing unit 3, the printing portion 42 is contained in the housing 6. The printing portion 42 carries out printing using ink on the printing medium P, which is transported in the Y axis direction by a transport device (not shown in drawings).

It should be noted that the transport device, which is not shown in the drawings, transports the printing media P intermittently in the Y axis direction. The printing portion 42 is configured to be capable of moving back and forth along the X axis by a movement device (not shown in drawings). The tank unit 4 supplies ink to the printing portion 42. It should be noted that in the printer 1, at least one area of the tank unit 4 protrudes outside of the housing 6. Also note that the printing portion 42 is contained in the housing 6. In this way, the portion 42 can be protected by the housing 6.

Here, the direction along the X axis is not limited to the direction completely parallel to the X axis, but also includes directions tilted due to error or tolerance or the like excluding directions orthogonal to the X axis. Similarly, the direction along the Y axis is not limited to the direction completely parallel to the Y axis, but also includes directions tilted due to error or tolerance or the like excluding directions orthogonal to the Y axis. The direction along the Z axis is not limited to the direction completely parallel to the Z axis, but also includes directions tilted due to error or tolerance or the like excluding directions orthogonal to the Z axis. That is, directions along an arbitrary axis or surface are not limited to directions completely parallel to these arbitrary axes or surfaces, but also includes directions tilted due to error or tolerance of the like excluding directions orthogonal to these arbitrary axes and surfaces.

The tank unit 4 has tanks 10. In the present embodiment the tank unit 4 has multiple tanks 10 (four in the present embodiment). The multiple tanks 10 are positioned outside the housing 6 of the printing unit 3. The multiple tanks 10 are contained inside the housing 7. In this way, the tanks 10 can be protected by the housing 7. The housing 7 is positioned outside the housing 6. The housing 7 is secured to the housing 6 with screws. In other words, the tank unit 4 is secured to the printing unit 3 with screws.

It should be noted that in the present embodiment the tank unit 4 has multiple (four) tanks 10. However, the number of tanks 10 is not limited to four and it is possible to utilize three or a number less than three tanks or a number exceeding four tanks.

Further still, in the present embodiment, the multiple tanks 10 are configured to be separate members from each other. However, the configuration of the tanks 10, which are one example of a liquid container, is not limited to this. A configuration in which multiple tanks 10 are integrally set as a single liquid container can also be utilized as a configuration of a liquid container. In this case, multiple liquid container units are arranged in a single liquid container. The multiple liquid container units are partitioned separately from each other and are configured so that different types of liquid can be contained. In this case, inks of different colors can be contained separately in the multiple liquid container units for example. Examples that can be offered of methods for integrally setting multiple tanks 10 in a single liquid container include a method in which multiple tanks 10 are integrally joined or combined, and a method in which multiple tanks 10 are integrally set using an integrated formation.

As shown in FIG. 3, an ink supply tube 43 is connected to each of the tanks 10. The ink inside the tank 10 is supplied to the printing portion 42 via the ink supply tube 43 from the tank unit 4. Printheads (not shown in drawings), which are one example of a liquid jetting head, are provided in the printing portion 42. Nozzle openings (not shown in drawings), which are faced toward the printing medium P, are formed in the printheads. The printheads are so-called inkjet style printheads. The ink supplied to the printing portion 42 via the ink supply tube 43 from the tank unit 4 is supplied to the printhead. And the ink supplied to the printing portion 42 is discharged as ink droplets toward the targeted printing medium P from the nozzle openings of the printhead. In this way the printheads can execute printing on the printing medium P.

The tanks 10 have an inlet portion 45 and a visual confirmation surface 46. For the tank 10, ink can be injected from outside the tank 10 to inside the tank 10 via the inlet portion 45. The inlet portion 45 is one example of an ink inlet portion that enables ink to be injected into the ink container portion 29. It should be noted that the operator can access the inlet portions 45 of the tanks 10 from outside the housing 7 by opening a cover 47 of the housing 7. The visual confirmation surfaces 46 oppose the window units 25. The operator is able to visually confirm the amount of ink in each of the tanks 10 by visually confirming the visual confirmation surfaces 46 of the tanks 10 via the window units 25.

It should be noted that it is also possible to utilize configurations for that tanks 10 in which an upper limit mark 48 or a lower limit mark 49 or the like is added to the visual confirmation surface 46. The operator is able to comprehend the amount of ink in the tanks 10 by using the upper limit mark 48 and the lower limit mark 49 as visual guides. It should be noted that the upper limit mark 48 indicates a yardstick of ink amount such that ink does not overflow the inlet portion 45 when injected through the inlet portion 45. Furthermore, the lower limit mark 49 indicates a yardstick of ink amount when injection of ink is to be prompted. Configurations can also be utilized in which at least one of the upper limit mark 48 and the lower limit mark 49 is provided on the tank 10.

The above example illustrates a case in which the printing unit 3 and the tank unit 4 are separate configurations. That is, in the above example, the housing 7 and the housing 6 are separate members. However, configurations can also be utilized in which the housing 7 and the housing 6 are integrated. That is, the tank unit 4 can be incorporated into the configuration of the printing unit 3. In a case where the housing 7 and the housing 6 are integrated, the multiple tanks 10 can be contained inside the housing 6 along with the printing portion 42 and the ink supply tubes 43.

Furthermore, the positional locations of the tanks 10 are not limited to lateral areas of the housing 6 in the X axis direction. Positional locations of the tanks 10 that can be utilized include for example also the front surface side of the housing 6 in the Y axis direction.

As shown in FIG. 3, the housing 7 includes a first housing 51 and a second housing 52. The first housing 51 is positioned farther in the −Z axis direction than the multiple tanks 10. The multiple tanks 10 are supported by the first housing 51 and the housing 6. However, configurations for supporting the tanks 10 are not limited to this. Furthermore, the second housing 52 is positioned farther in the Z axis direction than the first housing 51 and covers the multiple tanks 10 from the Z axis direction of the first housing 51. The multiple tanks 10 are covered by the first housing 51 and the second housing 52.

The second housing 52 has a cover 47. The cover 47 is positioned at an end area of the second housing 52 in the X axis direction. The cover 47 is configured as a portion of a lateral surface 28 that faces the X axis direction. The cover 47 is configured to be rotatable with respect to a main area 52A of the second housing 52. FIG. 3 illustrates a state in which the cover 47 is open with respect to the main area 52A of the second housing 52. When the cover 47 is opened with respect to the main area 52A of the second housing 52, the inlet portions 45 of the multiple tanks 10 are exposed. In this way, the operator can access the inlet portions 45 of the tanks 10 from outside the housing 7. It should be noted that the inlet portions 45 are sealed by cap members (not shown in drawings). When ink is to be injected into one of the tanks 10, ink is injected after the cap member is removed from the inlet portion 45 to open the inlet portion 45. It should be noted that in the printer 1, the inlet portions 45 face upward with respect to the horizontal direction in the usage position.

Figure 4:
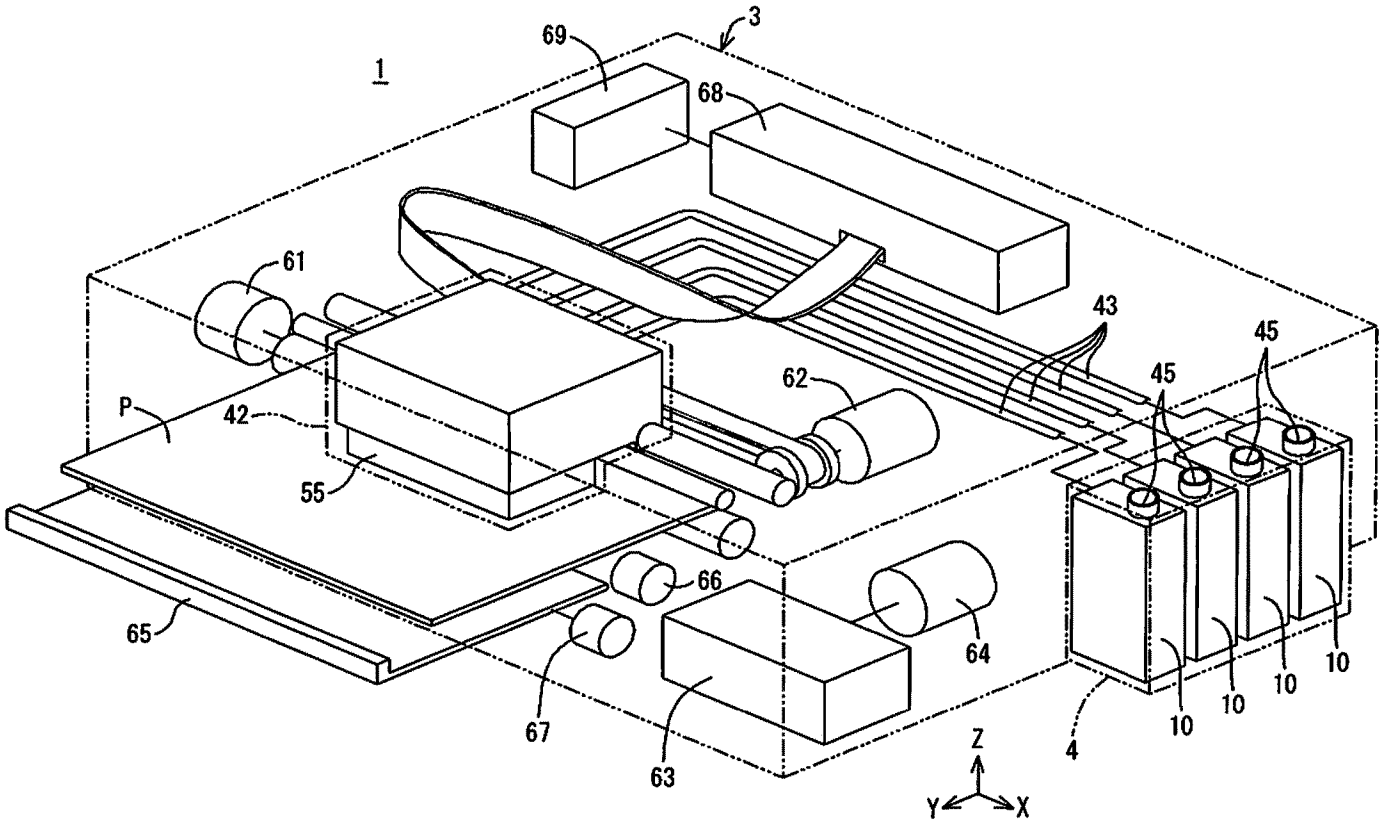
FIG. 4 is a perspective view that schematically shows main constituents of a printer according to the present embodiment.

As shown in FIG. 4, in the printer 1 having the aforementioned configuration, printing is carried out on the printing medium P by causing ink droplets to be discharged from the printhead 55 of the printing portion 42 at predetermined positions while causing the printing medium P to be transported in the Y axis direction and the printing portion 42 to be moved back and move along the X axis direction. It should be noted that in the printer 1, a motor is utilized (hereinafter referred to as transport motor 61) as a drive source of the transport device by which the printing medium P is transported in the Y axis direction. Furthermore, a motor is utilized (hereinafter referred to as movement motor 62) as a drive source of the movement device by which the the printing portion 42 is caused to move back and forth along the X axis direction.

Furthermore, in the printer 1, a maintenance unit 63 is provided for executing maintenance procedures on the printhead 55 of the printing portion 42. The maintenance unit 63 includes components such as a wiping device, a capping device, and a suction device and the like. The wiping device is a device for sweeping the nozzle surface on which the nozzle openings of the printhead 55 are formed. The capping device is a device for capping the nozzle surface on which the nozzle openings of the printhead 55 are formed. The suction device is a pump device that suctions ink inside the printhead 55 from the nozzle openings. The maintenance unit 63 is designed to maintain the performance of the printhead 55. In the printer 1, a motor is utilized (hereinafter referred to as a suction motor 64) as a drive source of the suction device.

Ink is not limited to either water-based inks or oil-based inks. Furthermore, water-based ink may be either a substance having a configuration in which a solute such as a dye is dissolved into a water-based solvent or a substance having a configuration in which a dispersoid such as a pigment is dispersed into a water-based dispersoid. Furthermore, oil-based ink may be either a substance having a configuration in which a solute such as a dye is dissolved into an oil-based solvent or a substance having a configuration in which a dispersoid such as a pigment is dispersed into an oil-based dispersoid.

Figure 5:
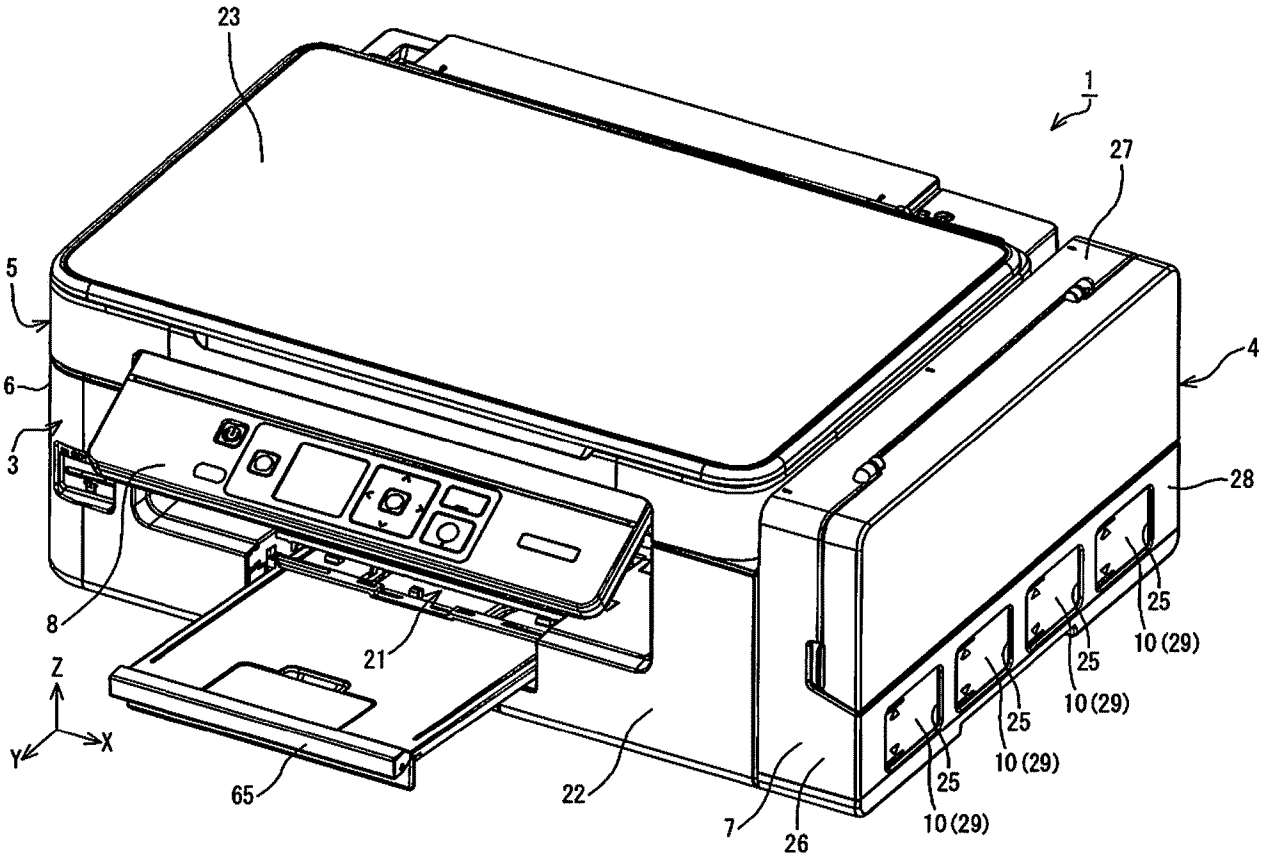
FIG. 5 is a perspective view showing main constituents of a printer according to the present embodiment.

It should be noted that when carrying out printing onto the printing medium P in the printer 1, as shown in FIG. 5, the panel 8 tilts upward and a stacker 65 protrudes. The panel 8 is configured to be capable of rotating centered on a rotating shaft (not shown in drawings) provided at an end portion side of the Z axis direction. The panel 8 tilts upward due to rotating centered on this rotating shaft. In this way, the operator can more easily visually confirm the panel 8. The stacker 65 is configured in a tray shape and receives and stops the printing medium P on which printing has been executed. The stacker 65 is configured to be capable of extending out of and retracting into the housing 6. By sliding the stacker 65 with respect to the housing 6, it is capable of extending out of and retracting into the housing 6.

As shown in FIG. 4, in the printer 1, a motor is utilized (hereinafter referred to as a panel tilt motor 66) as a drive source for rotation of the panel 8. Furthermore, a motor is utilized (hereinafter referred to as a stacker motor 67) as a drive source of extension and retraction of the stacker 65. It should be noted that driving of the printhead 55, the transport motor 61, the movement motor 62, the suction motor 64, the panel tilt motor 66, and the stacker motor 67 is controlled by a control unit 68. Furthermore, the electric power supplied to these drive sources and the printhead 55 and the control unit 68 and the like is supplied via a power supply unit 69. Furthermore, various sensors not shown in the drawings are installed in the printer 1 such as a sensor that detects a transport amount of the printing medium P transported in the Y axis direction and a sensor that detects a displacement amount of the printing portion 42.

In the printer 1, the printhead 55, the transport motor 61, the movement motor 62, the suction motor 64, the panel tilt motor 66, the stacker motor 67, the power supply unit 69, and the various sensors are all examples of heat sources respectively. Furthermore, in the printer 1, the display device 8C shown in FIG. 1 is an example of a heat source.

Figure 6:
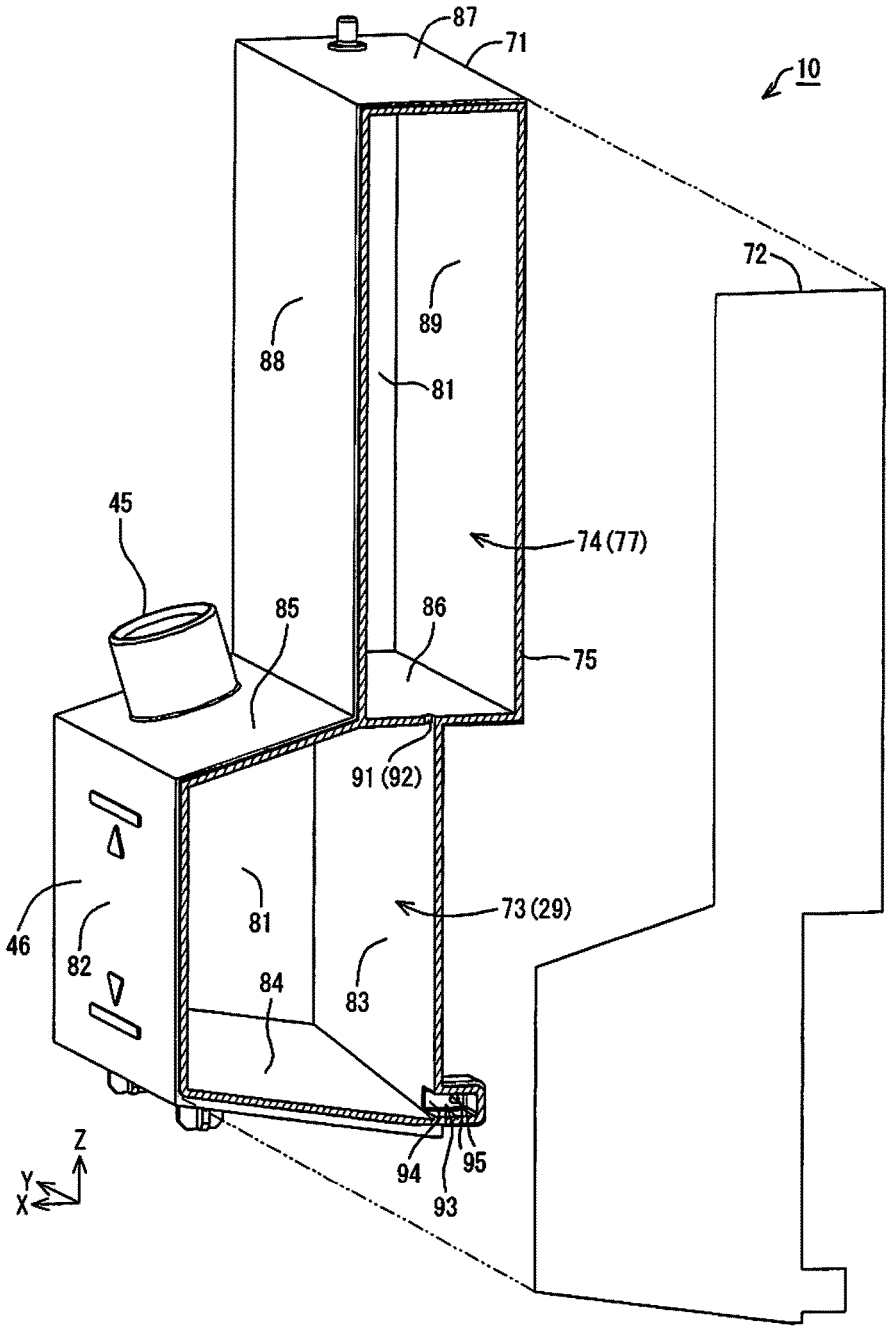
FIG. 6 is an exploded perspective view showing a tank according to the present embodiment.

As shown in FIG. 6, the tank 10 has a case 71, which is one example of a tank body, and a sheet member 72. The case 71 is configured using a synthetic resin such as nylon or polypropylene for example. Furthermore, the sheet member 72 is formed into a film shape using a synthetic resin (for example, nylon or polypropylene or the like) and has flexibility. In the present embodiment the sheet member 72 has optical transparency.

A recess portion 73 and a recess portion 74 are formed in the case 71. In the case 71, the recess portion 73 and the recess portion 74 are open toward the −Y axis direction. The recess portion 73 and the recess portion 74 are partitioned by a partition that is described later. Furthermore, a joining unit 75 is provided in the case 71. In FIG. 6, hatching is given for the joining unit 75 to facilitate understanding of its structure. The sheet member 72 is joined to the joining unit 75 of the case 71. In the present embodiment, the case 71 and the sheet member 72 are joined using deposition. When the sheet member 72 is joined to the case 71, the recess portion 73 and the recess portion 74 are blocked by the sheet member 72. The space enclosed by the recess portion 73 and the sheet member 72 is the ink container portion 29. Furthermore, the space enclosed by the recess portion 74 and the sheet member 72 is referred to as a buffer chamber 77 (described later).

As shown in FIG. 6, the case 71 has a partition 81, a partition 82, a partition 83, a partition 84, a partition 85, a partition 86, a partition 87, a partition 88, and a partition 89. As described earlier, the space enclosed by the recess portion 73 and the sheet member 72 is configured as the ink container portion 29. The recess portion 73 is demarcated by the partitions 81 to 86. And the ink container portion 29 is configured by blocking the recess portion 73, which is demarcated by the partitions 81 to 86, using the sheet member 72. For this reason, the partitions 81 to 86 and the sheet member 72 can be defined as walls that demarcate the ink container portion 29. The ink container portion 29 is enclosed by the multiple walls of the partitions 81 to 86 and the sheet member 72.

The space enclosed by the recess portion 74 and the sheet member 72 is configured as a buffer chamber 77. The recess portion 74 is demarcated by the partition 81 and partitions 86 to 89. And the buffer chamber 77 is configured by blocking the recess portion 74, which is demarcated by the partition 81 and the partitions 86 to 89, using the sheet member 72. For this reason, the partition 81, the partitions 86 to 89, and the sheet member 72 can be defined as walls that demarcate the buffer chamber 77. The buffer chamber 77 is enclosed by the multiple walls of the partition 81, the partitions 86 to 89, and the sheet member 72.

The partition 81 extends along the XZ plane. Each of the partitions 82 to 86 intersects the partition 81. The partitions 82 to 86 protrude from the partition 81 in the −Y axis direction. The partition 82 is positioned at an end area at the X axis direction side of the partition 81 and extends along the YZ plane. The surface of the partition 82 on the opposite side from the recess portion 73, that is, the surface on the X axis direction side of the partition 82, is set as the visual confirmation surface 46 shown in FIG. 3. Thus, the ink inside the recess portion 73 can be visually confirmed via the recess portion 82.

As shown in FIG. 6, the partition 83 is provided in a position facing the partition 82 sandwiching the recess portion 73. The partition 83 extends along the YZ plane. The partition 84 is positioned at an end area of the partition 81 in the −Z axis direction. The partition 84 is tilted with respect to the XZ plane. Furthermore, the partition 84 is tilted also with respect to both the XY plane and the YZ plane.

The partition 85 is provided in a position on the opposite side from the partition 84 sandwiching the recess portion 73. The partition 86 is also provided in a position on the opposite side from the partition 84 sandwiching the recess portion 73. The partition 85 is positioned at an X axis direction position of the partition 86. The partition 85 is tilted with respect to both the XY plane and the YZ plane. The partition 85 is orthogonal to the XZ plane. The partition 86 extends along the XY plane.

The partition 82 intersects the partition 85 at an end portion in the Z axis direction. Furthermore, the partition 82 intersects the partition 84 at an end portion in the −Z axis direction. The partition 83 intersects the partition 86 at an end portion in the Z axis direction. Furthermore, the partition 83 intersects the partition 84 at an end portion in the −Z axis direction. The partition 85 intersects the partition 86 at an end portion in the −X axis direction. In accordance with the above-described configuration, the partitions 82 to 86 enclose one area of the partition 81. In this way, the recess portion 73 is configured having the partition 81 as a bottom area.

The partition 87, which demarcates the recess portion 74, is provided in a position on the opposite side from the partition 86 sandwiching the recess portion 74, that is, it is provided in a position farther in the Z axis direction than the partition 86. The partition 87 extends along the XY plane. The partition 88 is positioned at an X axis direction position of the partition 74 and extends along the YZ plane. The partition 89 is provided in a position on the opposite side from the partition 88 sandwiching the recess portion 74, that is, it is provided in a position farther in the −X axis direction than the partition 88. The partition 89 extends along the YZ plane.

The partition 88 intersects the partition 86 at an end portion in the −Z axis direction. Furthermore, the partition 88 intersects the partition 87 at an end portion in the Z axis direction. The partition 89 intersects the partition 86 at an end portion in the −Z axis direction. Furthermore, the partition 89 intersects the partition 87 at an end portion in the Z axis direction. In accordance with the above-described configuration, the partitions 86 to 89 enclose one area of the partition 81. In this way, the recess portion 74 is configured having the partition 81 as a bottom area.

It should be noted that the partitions 81 to 87 are not limited to being flat walls and may be components that include bumpiness or a curved surface. Furthermore, the amount of protrusion of the partitions 82 to 89 from the partition 81 is set as a mutually equivalent protrusion amount. Furthermore, the partition 81 of the recess portion 73 and the partition 81 of the recess portion 74 are the same wall. That is, the recess portion 73 and the recess portion 74 share the partition 81. Furthermore, the partition 86 of the recess portion 73 and the partition 86 of the recess portion 74 are the same wall. That is, the recess portion 73 and the recess portion 74 share the partition 86.

A notch 91 is formed at a position on the partition 86 where the recess portion 74 and the recess portion 73 intersect. The position on the partition 86 where the recess portion 74 and the recess portion 73 intersect is an area on the partition 86 between the partition 83 and the partition 88. The notch 91 is formed in an orientation such that it is recessed in the Y axis direction from an end portion of the partition 86 in the −Y axis direction. For this reason, when the sheet member 72 is joined to the case 71, the recess portion 73 and the recess portion 74 are mutually communicable via the notch 91. The space enclosed by the notch 91 and the sheet member 72 is configured as a communicating channel 92 (described later).

Here, a recess portion 93 is formed inside the recess portion 73. The recess portion 93 is arranged in an orientation such that it is recessed toward the −X axis direction from the partition 83. Furthermore, the recess portion 93 is arranged in an orientation such that it is recessed toward the Y axis direction. An ink supply port 95 is arranged in a partition 94 that demarcates the recess portion 93. The ink inside ink container portion 29 is supplied to the ink supply tube 43 (FIG. 4) via the ink supply port 95.

The sheet member 72 opposes the partition 81 sandwiching the partitions 82 to 89 in the Y axis direction. When viewed from a planar view in the Y axis direction, the sheet member 72 has a size and shape that covers the recess portion 73, the recess portion 74, and the recess portion 93. The sheet member 72 is joined to the joining unit 75 in a state in which there is a gap between itself and the partition 81. In this way, the recess portion 73, the recess portion 74, and the recess portion 93 are sealed by the sheet member 72. Thus, the sheet member 72 can be considered as a lid for the case 71.

Figure 7:
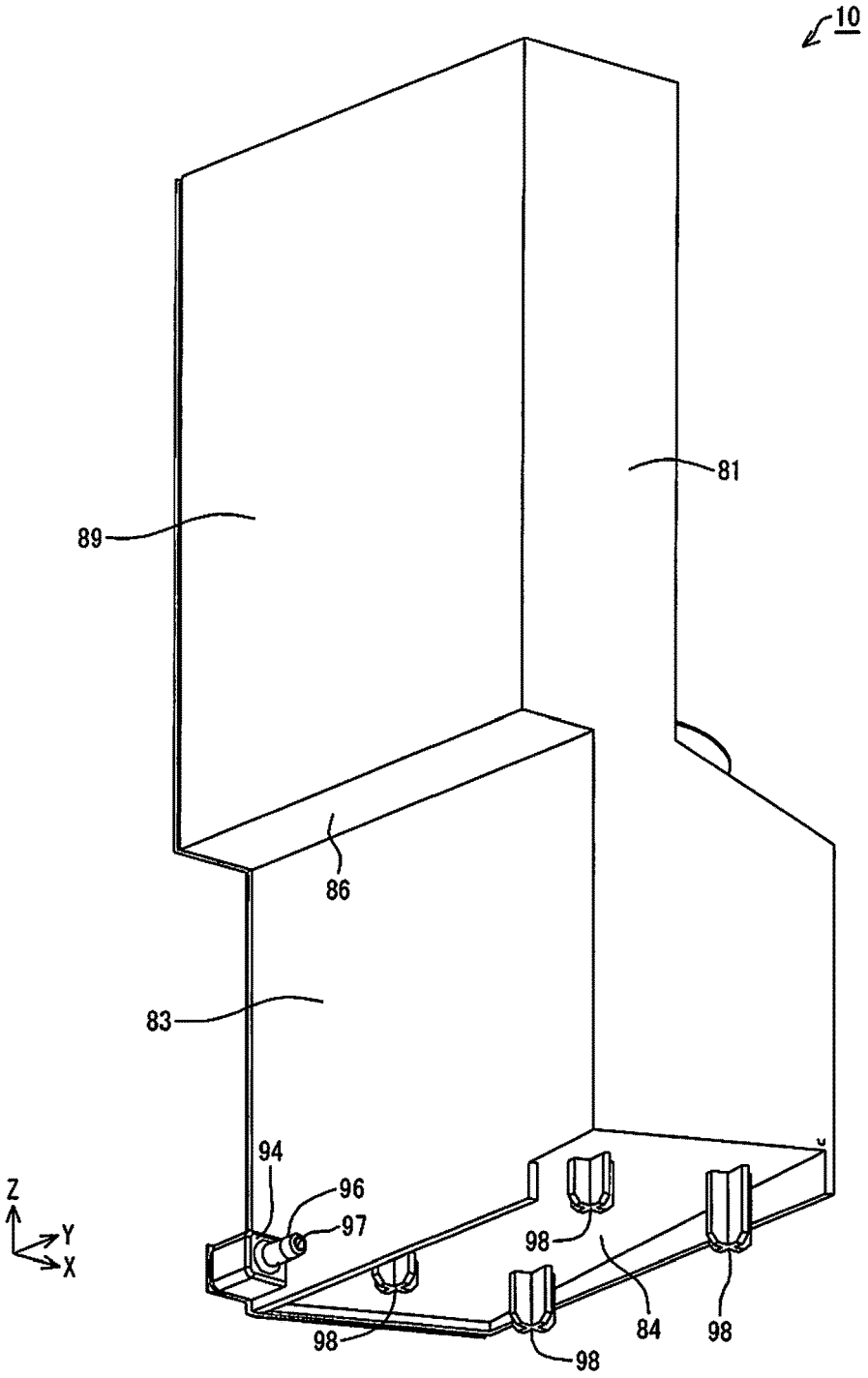
FIG. 7 is a perspective view showing a tank according to the present embodiment.

As shown in FIG. 7, an ink supply unit 96 is arranged at the partition 94 in the tank 10. The ink supply unit 96 communicates with the ink supply port 95 (FIG. 6). As shown in FIG. 7, the ink supply unit 96 protrudes from the partition 94 in the Y axis direction. A lead-out port 97 that opens to the Y axis direction is formed in the ink supply unit 96. In the present embodiment, the ink supply tube 43 (FIG. 4) connects to the ink supply unit 96. The ink inside the tank 10 is supplied to the ink supply tube 43 (FIG. 4) from the ink supply port 95 via the ink supply unit 96 and the lead-out port 97.

Leg units 98 are arranged on a −Z axis direction surface of the partition 84. In the present embodiment, multiple leg units 98 are arranged. The leg units 98 protrude in the −Z axis direction from the partition 84. The leg units 98 are utilized for positioning and securing when arranging the tank 10 in the first housing 51 (FIG. 3).

Figure 8:
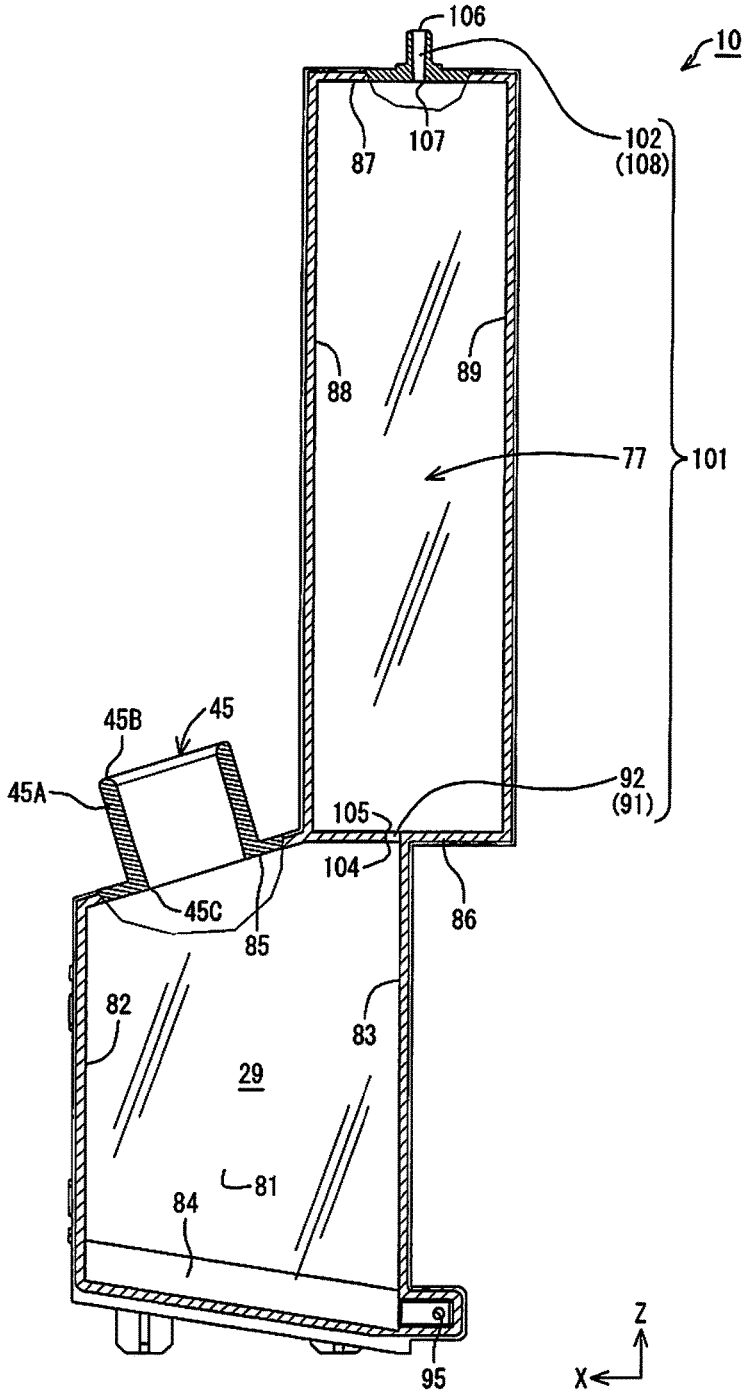
FIG. 8 is a drawing showing an external view of a tank according to the present embodiment.

As shown in FIG. 8, the tank 10 has an ink container portion 29 and an atmosphere introducing unit 101. The atmosphere introducing unit 101 includes the communicating channel 92, the buffer chamber 77, and an atmosphere communicating channel 102. The atmosphere introducing unit 101 is a flow channel for atmosphere between the outside of the tank 10 and the inside of the ink container portion 29. It should be noted that in order to facilitate understanding of the configuration of the atmosphere communicating channel 102 and the inlet portion 45, FIG. 8 shows a state in which a portion of the tank 10 is in a cross section.

The atmosphere introducing unit 101 communicates with the outside of the tank 10 through the atmosphere communicating channel 102. Furthermore, the atmosphere introducing unit 101 communicates with the inside of the ink container portion 29 through the communicating channel 92. The ink container portion 29 communicates with the outside of the tank 10 via the communicating channel 92, the buffer chamber 77, and the atmosphere communicating channel 102. In other words, the ink container portion 29 is open to the atmosphere via the communicating channel 92, the buffer chamber 77, and the atmosphere communicating channel 102.

The communicating channel 92 is a flow channel for atmosphere between a communicating port 104 and a communicating port 105. In the present embodiment, the communicating channel 92 is configured as the notch 91 formed in the partition 86. For this reason, in the present embodiment, a route length of the communicating channel 92 is equivalent to a thickness dimension of the partition 86. The communicating port 104 is defined as an opening formed at an intersecting portion where the inner wall of the ink container portion 29 and the communicating channel 92 intersect. In other words, the communicating port 104 is a location where the communicating channel 92 connects to the ink container portion 29. Furthermore, the communicating port 105 is defined as an opening formed at an intersecting portion where the inner wall of the buffer chamber 77 and the communicating channel 92 intersect. In other words, the communicating port 105 is a location where the communicating channel 92 connects to the buffer chamber 77.

The atmosphere communicating channel 102 is a flow channel for atmosphere between an open-atmosphere port 106 and a communicating port 107. In the present embodiment, the atmosphere communicating channel 102 has a configuration that includes an introducing channel 108 formed in the partition 87 and a thickness of the partition 87. For this reason, in the present embodiment, a route length of the atmosphere communicating channel 102 is equivalent to a length in which the route length of the introducing channel 108 and a thickness dimension of the partition 87 are added together. The open-atmosphere port 106 is defined as an opening that opens to the outside of the tank 10 in the atmosphere communicating channel 102. Furthermore, the communicating port 107 is defined as an opening formed at an intersecting portion where the inner wall of the buffer chamber 77 and the atmosphere communicating channel 102 intersect. In other words, the communicating port 107 is a location where the atmosphere communicating channel 102 connects to the buffer chamber 77. It should be noted that the introducing channel 108 is provided in the present embodiment, but it is also possible to utilized a configuration in which the introducing channel 108 is omitted. For a tank 10 in which the introducing channel 108 is omitted, the route length of the atmosphere communicating channel 102 is equivalent to the thickness dimension of the partition 87.

The inlet portion 45 is provided on the partition 85. A tube portion 45A of the inlet portion 45 is provided on a surface facing upward on the partition 85 and protrudes from the partition 85 toward the opposite side from the ink container portion 29. An ink introducing port 45B opens at an upper end on the opposite side from the ink container portion 29 of the tube portion 45A. On the other hand, an ink inlet port 45C opens at an intersecting area where a surface of the ink container portion 29 side and the tube portion 45A intersect on the partition 85. The ink inlet port 45C is an open portion that opens toward the ink container portion 29 on the partition 85 of the inlet portion 45. Ink that has been injected from the ink introducing port 45B flows into the ink container portion 29 from the ink inlet port 45C via the tube portion 45A. The ink inlet port 45C corresponds to a liquid inlet port.

The buffer chamber 77 is positioned at a Z axis direction position of the ink container portion 29. That is, the buffer chamber 77 is positioned above the ink container portion 29. The ink container portion 29 and the buffer chamber 77 are lined up in a vertical direction sandwiching the partition 86. The inlet portion 45 is formed on top of the ink container portion 29 and is positioned in a position farther in the X axis direction than the buffer chamber 77.

Furthermore, in the tank 10, the partition 83 is positioned in a position farther in the X axis direction than the partition 89. For this reason, a level difference exists between the partition 89 and the partition 83 in the X axis direction. Accordingly, the buffer chamber 77 is displaced from the ink container portion 29 in the −X axis direction.

Accompanying printing by the printhead 55, ink from inside the ink container portion 29 is sent to the printhead 55. Thus, accompanying printing by the printhead 55, the pressure inside the ink container portion 29 becomes less than atmospheric pressure. When the pressure inside the ink container portion 29 becomes less than atmospheric pressure, the atmosphere inside the buffer chamber 77 is sent into the ink container portion 29 by way of the communicating channel 92. In this way, the pressure inside the ink container portion 29 is readily maintained at atmospheric pressure. It should be noted that atmosphere flows into the buffer chamber 77 from the open-atmosphere port 106, the atmosphere communicating channel 102, and the communicating port 107 in this order. As stated earlier, the ink inside the tank 10 is supplied to the printhead 55. When the ink inside the ink container portion 29 of the tank 10 is consumed and the remaining amount of ink becomes small, the operator can inject new ink from the inlet portion 45 into the ink container portion 29.

In the tank 10, when the posture of the tank 10 has been altered at a time such as when the printer 1 is relocated for example, ink tends to remain in the buffer chamber 77 even when the ink inside the ink container portion 29 has flowed into the atmosphere introducing unit 101. For this reason, with the tank 10 it is possible to keep low the risk of ink from inside the ink container portion 29 leaking out to the outside of the tank 10 from the open-atmosphere port 106.

Figure 9:
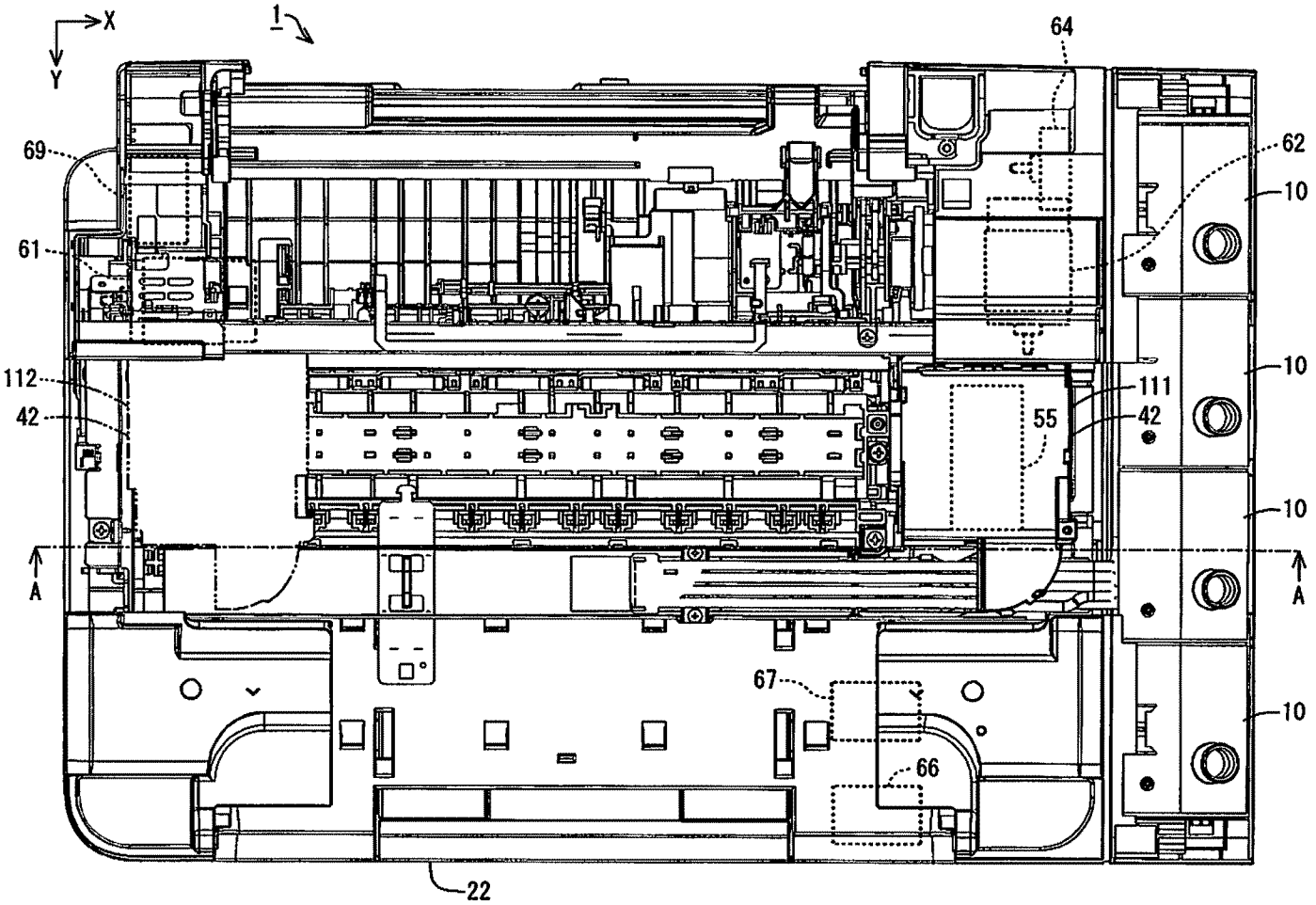
FIG. 9 is a planar view showing main constituents of a printer according to the present embodiment.

It should be noted that in the printer 1 according to the present embodiment, the printing portion 42 is configured to be capable of moving back and forth in a movable range between between a standby position 111 and a turn-back position 112 as shown in FIG. 9. The ink supply tubes 43 that are connected to the tanks 10 and the printing portion 42 are configured to be capable of extending and retracting flexibly following the reciprocal movement of the printing portion 42. It should be noted that in FIG. 9, illustration of components such as the scanner unit 5 (FIG. 3) and the housing 7 is omitted to facilitate understanding of the configuration.

The movement motor 62, which produces power for causing the printing portion 42 to move, is positioned in a position in the −Y axis direction of the standby position 111. That is, the movement motor 62 is positioned in a position farther in the −Y axis direction than the printing portion 42.

Furthermore, the movement motor 62 is positioned in a position in the −X axis direction of the tanks 10. The standby position 111 is positioned in a position in the −X axis direction of the tanks 10. Thus, the printhead 55 of the printing portion 42 is positioned in a position in the −X axis direction of the tanks 10. Further still, the transport motor 61, the suction motor 64, the panel tilt motor 66, the stacker motor 67, and the power supply unit 69 are also positioned in −X axis direction positions of the tanks 10.

The transport motor 61, the suction motor 64, and the power supply unit 69 are positioned in positions farther in the −Y axis direction than the printing portion 42. The transport motor 61 and the power supply unit 69 are positioned in positions farther in the −X axis direction than the movement motor 62. The transport motor 61 and the power supply unit 69 are positioned in −Y axis direction positions of the turn-back position 112. In this way, in the printer 1, various configurations capable of becoming heat sources are positioned in positions farther in the −X axis direction than the tanks 10.

Figure 10:
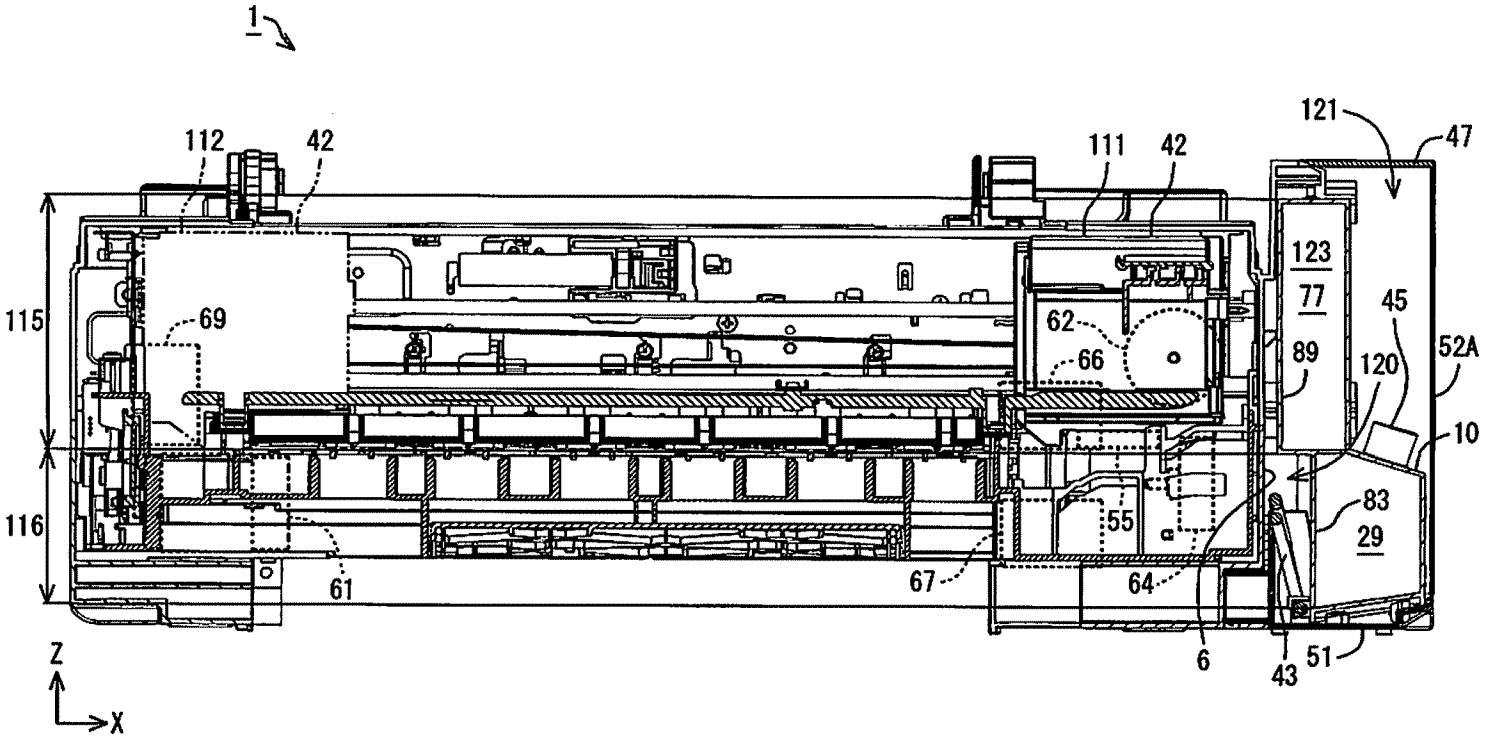
FIG. 10 is a cross-sectional view of an A-A line in FIG. 9.

Furthermore, as shown in FIG. 10, which is a cross-sectional view of an A-A line in FIG. 9, the movement motor 62 is positioned in the −X axis direction of the buffer chambers 77 of the tanks 10. That is, the movement motor 62 and the buffer chambers 77 are lined up along the X axis. For this reason, when the tanks 10 are moved parallel to the −X axis direction, the movement motor 62 overlaps a trajectory delineated by the buffer chambers 77.

In a state in which the printer 1 is viewed from the front surface 22 (FIG. 1), that is, in a state in which the printer 1 is viewed in the −Y axis direction, a region of the trajectory delineated by the buffer chambers 77 when the tanks 10 are moved parallel to the −X axis direction is referred to as a first region 115. Similarly, in a state in which the printer 1 is viewed in the −Y axis direction, a region of the trajectory delineated by the ink container portions 29 when the tanks 10 are moved parallel to the −X axis direction is referred to as a second region 116.

The above-described movement motor 62 overlaps the first region 115 and is contained within the first region 115. The printhead 55, the panel tilt motor 66, and the power supply unit 69 also overlap the first region 115 and are contained within the first region 115. It should be noted that the above-mentioned display device 8C (FIG. 1) also overlaps the first region 115 and is contained within the first region 115.

Furthermore, as shown in FIG. 10, the transport motor 61 and the stacker motor 67 respectively overlap the second region 116 and are contained within the second region 116. The suction motor 64 is positioned in the −X axis direction of the ink container portions 29. That is, the suction motor 64 and the ink container portions 29 are lined up along the X axis. The suction motor 64 overlaps the second region 116 and spans from the second region 116 to the first region 115.

Here, as described earlier, there is a level difference in the X axis direction between the partition 89 and the partition 83 in the tanks 10. That is, the buffer chamber 77 is displaced from the ink container portion 29 in the −X axis direction. Due to this configuration, a space formation unit 120 is formed between the partition 83 and the housing 6. In a broad sense, the space formation unit 120 is a space demarcated by the tank 10 and the housing 6. According to this definition, a space between the partition 89 of the tank 10 and the housing 6 is also included in the space formation unit 120.

In a narrow sense, the space formation unit 120 is a space along the X axis between the partitions 83 of the tanks 10 and the housing 6. According to this definition, the space formation unit 120 is a region in which the second region 116 overlaps the space between the tanks 10 and the housing 6. In the present embodiment, the space formation unit 120 is an example of a low thermal conductance part. Space is utilized in the space formation unit 120 such that the ink supply tubes 43 are arranged locally. That is, the ink supply tubes 43, which are one example of an ink flow channel, pass through the space formation unit 120.

The space formation unit 120 is positioned between the movement motor 62 and the ink container portion 29. The space formation unit 120 is positioned between the printhead 55 and the ink container portion 29. The space formation unit 120 is positioned between the panel tilt motor 66 and the ink container portion 29. The space formation unit 120 is positioned between the power supply unit 69 and the ink container portion 29. The space formation unit 120 is positioned between the display device 8C (FIG. 1) and the ink container portion 29. The space formation unit 120 is positioned between the transport motor 61 and the ink container portion 29. The space formation unit 120 is positioned between the stacker motor 67 and the ink container portion 29. The space formation unit 120 is positioned between the suction motor 64 and the ink container portion 29. Furthermore, the space formation unit 120 is positioned between the various sensors and the ink container portions 29.

In other words, in the present embodiment, the space formation unit 120, which is one example of a low thermal conductance part, is positioned between the various heat sources and the ink container portions 29. The space formation unit 120, which is one example of a low thermal conductance part, reduces thermal conductance from each of the heat sources to the ink container portions 29. In this way, in the printer 1, a low thermal conductance part is positioned between the heat sources and the ink container portions 29, and therefore the conveyance of heat from the heat sources to the ink within the ink container portions 29 can be kept low. According to the present embodiment, the printer 1 can be provided that gives consideration to the effect of heat sources on the ink inside the ink container portions 29.

For the present embodiment, in FIG. 9 in which the printer 1 is shown in planar view to the −Z axis direction, the direction in which front surface 22 faces is frontward and the direction facing opposite to frontward is backward. At this time, a front-back direction of the printer 1 is a direction along the Y axis. And a left-right direction that intersects the front-back direction of the printer 1 is a direction alone the X axis. As shown in FIG. 10, in the printer 1, the various heat sources, the space formation unit 120, which is one example of a low thermal conductance part, and the ink container portion 29 are positioned in a direction along the X axis, which is the left-right direction. According to this configuration, each of the heat sources, the space formation unit 120, which is one example of a low thermal conductance part, and the ink container portion 29 are positioned easily, that is, the space formation unit 120 is positioned between each of the heat sources and the ink container portion 29, and therefore it is easier to avoid increasing the size of the printer 1.

Furthermore, as shown in FIG. 10, in the present embodiment the space formation unit 120 is formed outside the tank 10. According to this configuration, the space formation unit 120 is provided outside the tank 10, and therefore it is easier to avoid increasing the size of the tank 10.

Furthermore, as shown in FIG. 10, in the present embodiment the ink supply tubes 43, which are one example of an ink flow channel, pass through the space formation unit 120. According to this configuration, the space inside the space formation unit 120 can be cooled by the flow of ink in the ink supply tubes 43. In this way, the conveyance of heat from the heat sources to the ink within the ink container portions 29 can be kept even further lower.

Furthermore, in the present embodiment, as shown in FIG. 10, in the usage position of the printer 1 when the printer 1 is viewed from the front surface, a region enclosed by the housing 6, the cover 47, the main area 52A, and the first housing 51 configures a rectangular region 121. The tanks 10 are positioned within the rectangular region 121. Furthermore, each of the heat sources is positioned outside the rectangular region 121. Of the heat sources, the printhead 55 positioned inside the first region 115, the movement motor 62, the panel tilt motor 66, the power supply unit 69, and the display device 8C (FIG. 1) are positioned further upward than the ink container portions 29. Furthermore, in the tanks 10, the buffer chambers 77 are positioned further upward than the ink container portions 29.

Here, the buffer chambers 77 are positioned respectively between the printhead 55 positioned inside the first region 115, the movement motor 62, the panel tilt motor 66, the power supply unit 69, and the display device 8C (FIG. 1), which are heat sources, and the ink container portions 29. Thus, the buffer chambers 77 are one example of a low thermal conductance part. In this case, the buffer chambers 77 also represent a space formation unit 123 as one example of a low thermal conductance part. The space formation units 123 are positioned within the rectangular region 121. And the space formation units 123 are positioned further upward than the ink container portions 29.

In this configuration, the inlet portion 45 is formed above the ink container portion 29 and positioned on an opposite side from the heat source side farther than the space formation unit 123. That is, the space formation units 123 are positioned respectively between the printhead 55, the movement motor 62, the panel tilt motor 66, the power supply unit 69, and the display device 8C (FIG. 1), which are heat sources, and the ink container portions 29. According to this configuration, in the printer 1, the inlet portion 45 is positioned sandwiching the space formation unit 123 on an opposite side from the heat source side, and therefore the conveyance of heat from the heat sources to the ink being injected into the inlet portion 45 can be kept low.

Modified Example 1

Figure 11:
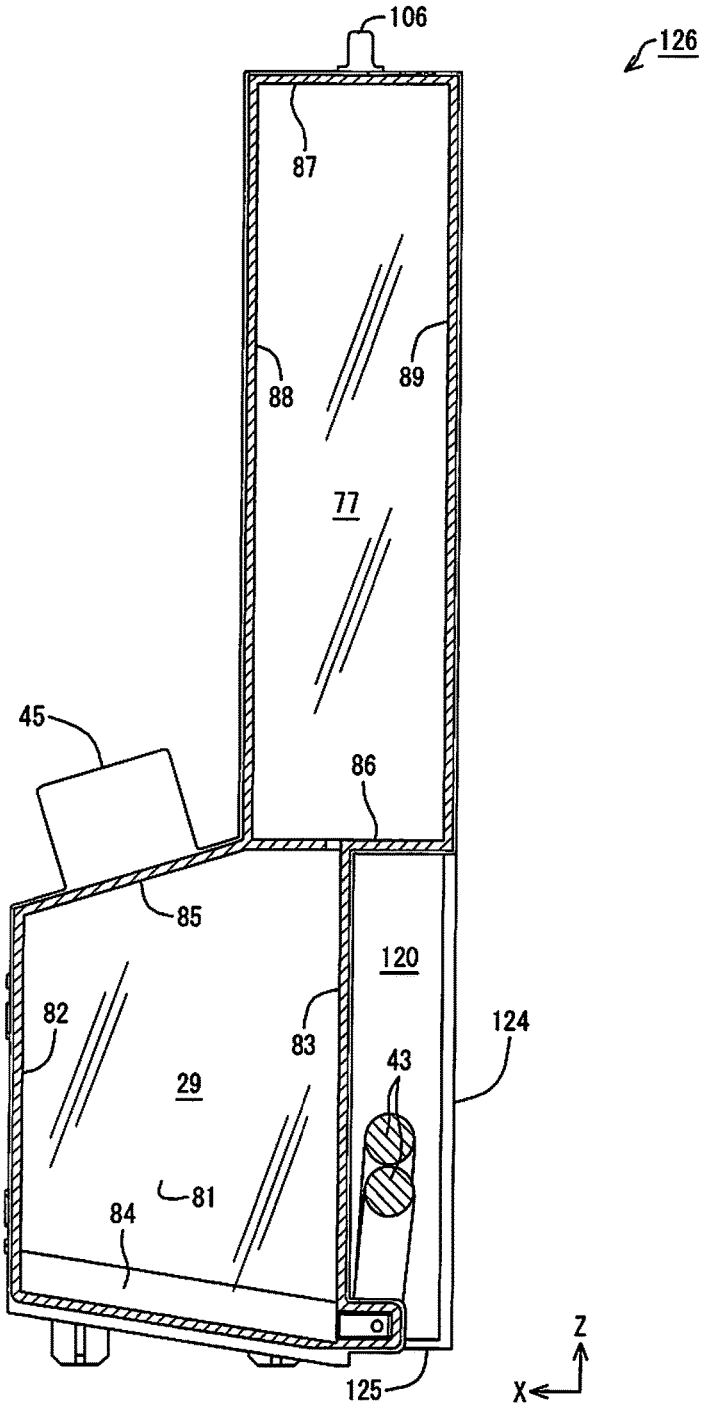
FIG. 11 is cross-sectional view showing a tank in Modified Example 1.

As shown in FIG. 10, in the printer 1 in which the tanks 10 are utilized, the space formation unit 120 is demarcated by the tank 10 and the housing 6. However, configurations of the space formation unit 120 are not limited to this. For example, as shown in FIG. 11, a configuration demarcated by a partition 124 and a partition 125, which are appended to the tank 10, and the partition 83 and the partition 86 can also be utilized as the space formation unit 120. The tank 10 to which the partition 124 and the partition 125 have been appended is indicated as a tank 126 of Modified Example 1. For configurations of the tank 126, in regard to configurations identical to the configuration of the tank 10 or configurations having an equivalent function, same symbols are used as for the configuration of the tank 10 and detailed description thereof is omitted.

In the tank 126 of Modified Example 1, the partition 124 is positioned in a −X axis direction of the partition 83 and opposes the partition 83. The partition 124 is positioned at a −Z axis direction position of the partition 89. From other viewpoints, the partition 124 can be considered as a portion in which the partition 89 has been extended in the −Z axis direction. The partition 125 is positioned in a −Z axis direction of the partition 86 and opposes the partition 86. The partition 125 protrudes in the −X axis direction from the partition 83. In the tank 126, the space formation unit 120 is configured by a space that is enclosed by the partition 124, the partition 125, the partition 83, and the partition 86.

In Modified Example 1, the space formation unit 120 is formed integrally with the tank 126, and therefore the space formation unit 120 can be considered to be inside the tank 126. And in Modified Example 1, a configuration can also be utilized in which the ink supply tubes 43 pass through the space formation unit 120. In this configuration, the ink supply tubes 43 pass through the space formation unit 120, which is provided inside the tank 126.

Modified Example 2

Figure 12:
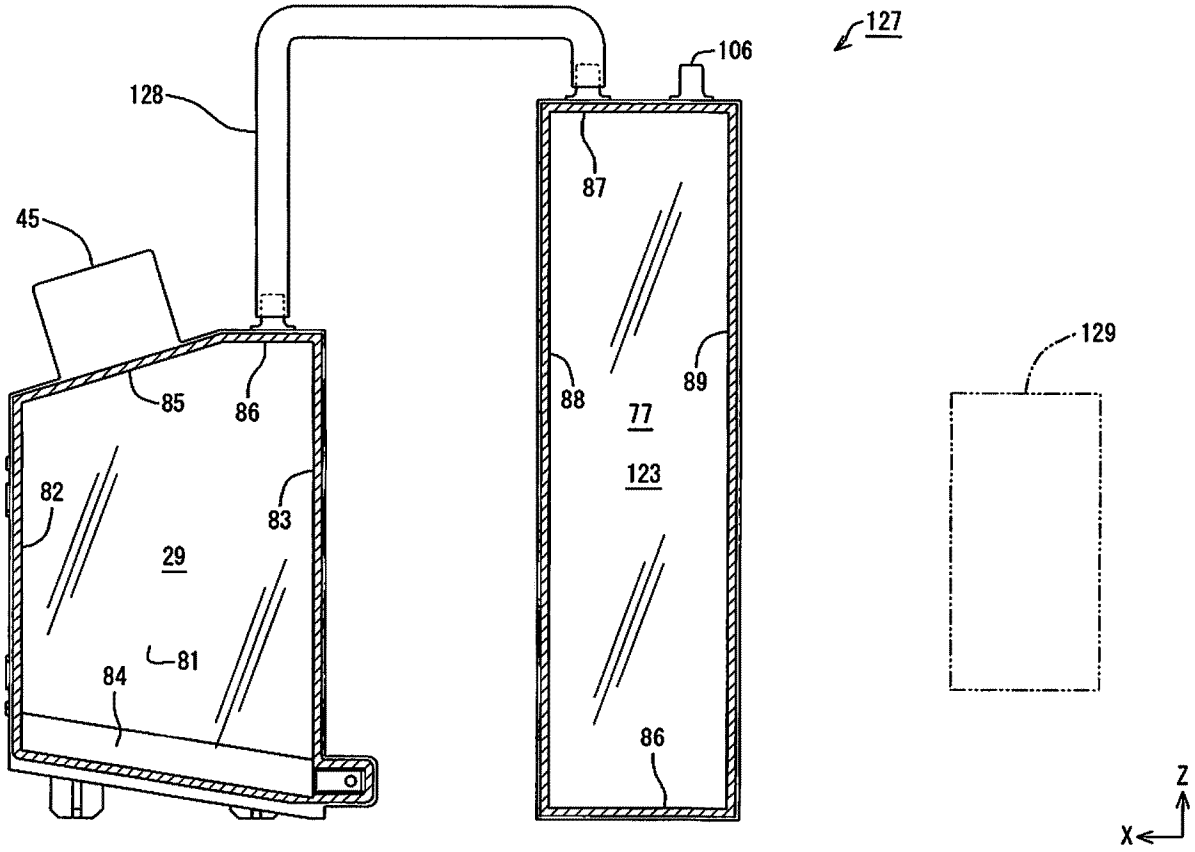
FIG. 12 is a diagram for describing schematically a configuration of a tank in Modified Example 2.

In the tank 10 and the tank 126, the ink container portion 29 and the buffer chamber 77 are formed integrally. However, as shown in FIG. 12, configurations may also be utilized in which the ink container portion 29 and the buffer chamber 77 are separate structures. A configuration in which the ink container portion 29 and the buffer chamber 77 are separate structures is indicated as a tank 127 of Modified Example 2. For configurations of the tank 127, in regard to configurations identical to the configuration of the tank 10 or configurations having an equivalent function, same symbols are used as for the configuration of the tank 10 and detailed description thereof is omitted.

In the tank 127 of Modified Example 2, the ink container portion 29 and the buffer chamber 77 communicate by way of a tube 128 such as a tube having flexibility. As long as the tube 128 is configured by a flexible tube or the like, a high degree of freedom can be achieved for the positioning of the buffer chamber 77, and therefore greater compactness of the printer 1 can be more readily achieved. Also in a printer 1 that utilizes the tank 127, by positioning the buffer chamber 77 between a heat source 129 and the ink container portion 29, the buffer chamber 77 can become a space formation unit 123, which is one example of a low thermal conductance part. In the tank 127 of Modified Example 2, there is a high degree of freedom for the positioning of the space formation unit 123, and therefore arrangements are readily achieved in positions having an effective reduction in thermal conductance from positions between the heat source 129 and the ink container portion 29.

Modified Example 3

Description is given of an example in which a wall that demarcates the ink container portion 29 provides a low thermal conductance part 131 as a tank 130 of Modified Example 3. For configurations of the tank 130, in regard to configurations identical to the configuration of the tank 10 or configurations having an equivalent function, same symbols are used as for the configuration of the tank 10 and detailed description thereof is omitted. Furthermore, various modified examples are included in the tank 130. For this reason, hereinafter, in order to distinguish between modified examples of the tank 130, different alphabetic letters or symbols are appended for each modified example to the symbols of constitutional components of the tank 130 and the low thermal conductance part 131.

Figure 13:
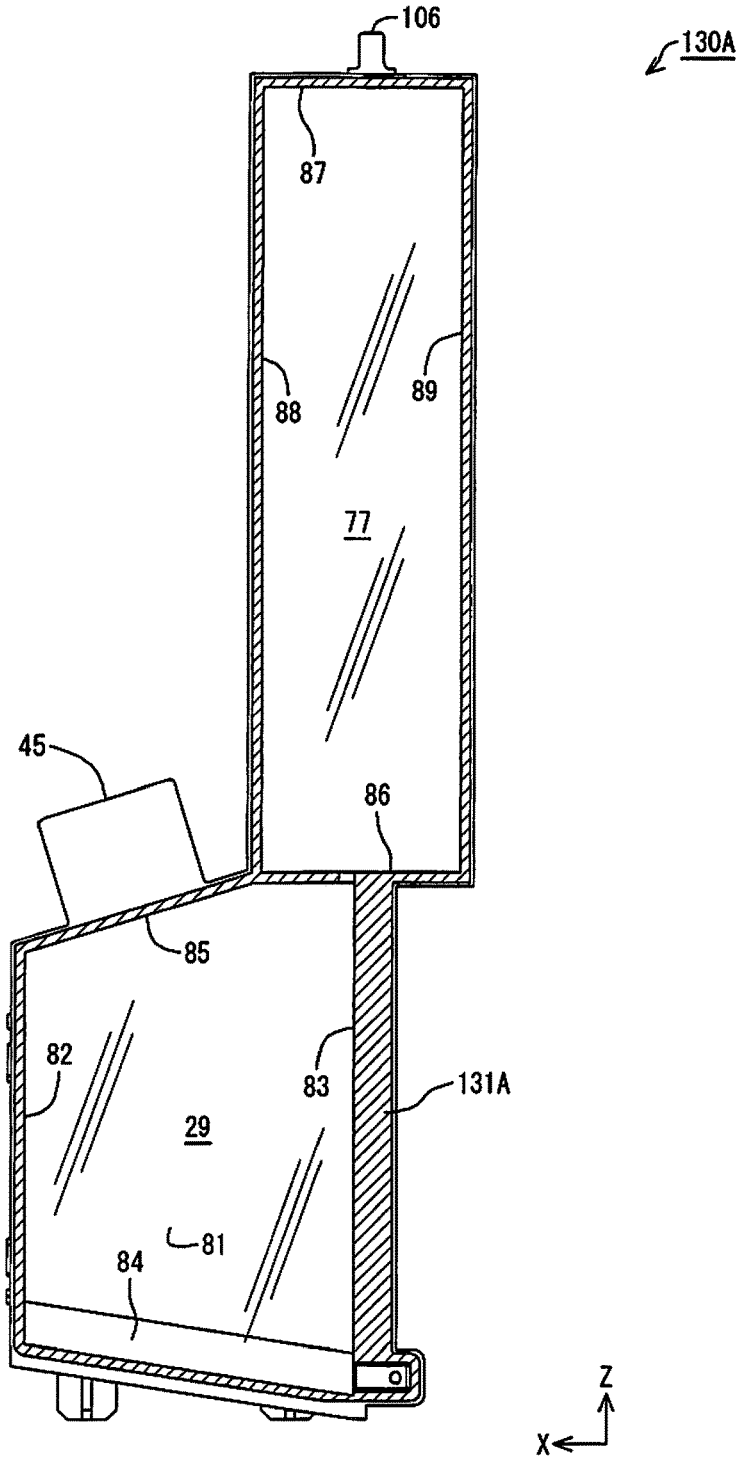
FIG. 13 is a cross-sectional view showing a tank in Modified Example 3.

As shown in FIG. 13, in a tank 130A of Modified Example 3, of the walls that demarcate the ink container portion 29, the partition 83 provides a low thermal conductance part 131A. The low thermal conductance part 131A has a configuration in a thickness of the partition 83 is formed thicker than the tank 10. That is, in the tank 130A, the low thermal conductance part 131A is configured by the thickness of the partition 83. According to the low thermal conductance part 131A having a configuration in which the thickness of the partition 83 is formed thicker, the conveyance of heat from the heat sources to the ink within the ink container portions 29 can be kept lower. The wall providing the low thermal conductance part 131A is not limited to the partition 83 and may be any wall that demarcates the ink container portion 29.

Modified Example 4

Figure 14:
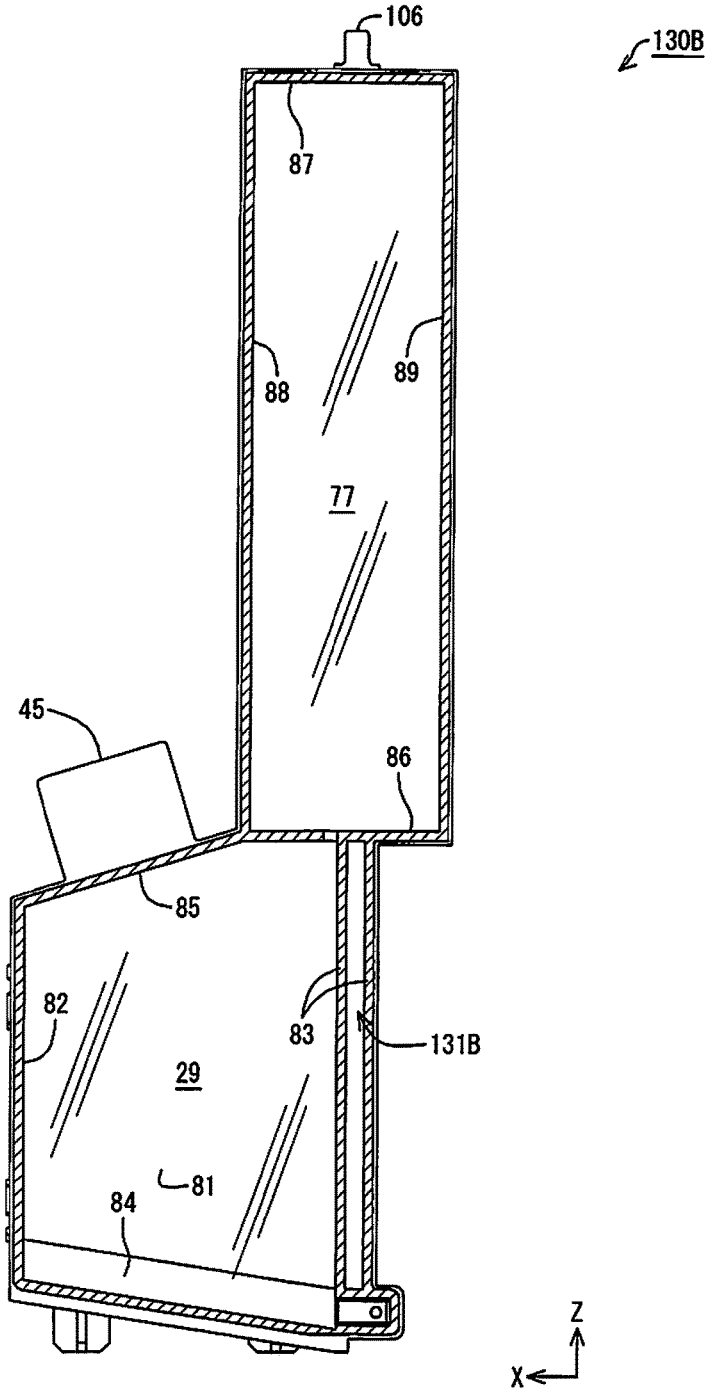
FIG. 14 is a cross-sectional view showing a tank in Modified Example 4.

As shown in FIG. 14, in a tank 130B of Modified Example 4, of the walls that demarcate the ink container portion 29, the partition 83 provides a low thermal conductance part 131B. The low thermal conductance part 131B has a configuration in which the partition 83 is constructed in two layers. In other words, in the tank 130B, the low thermal conductance part 131B is configured using a two-layer structure of the partition 83. It should be noted that the configuration of the partition 83 is not limited to a two-layer structure and configurations may also be utilized having a three-layer structure or exceeding three layers. According to the low thermal conductance part 131B in which the partition 83 is configured using multiple walls, the conveyance of heat from the heat sources to the ink within the ink container portions 29 can be kept lower. The wall providing the low thermal conductance part 131B is not limited to the partition 83 and may be any wall that demarcates the ink container portion 29.

Modified Example 5

Figure 15:
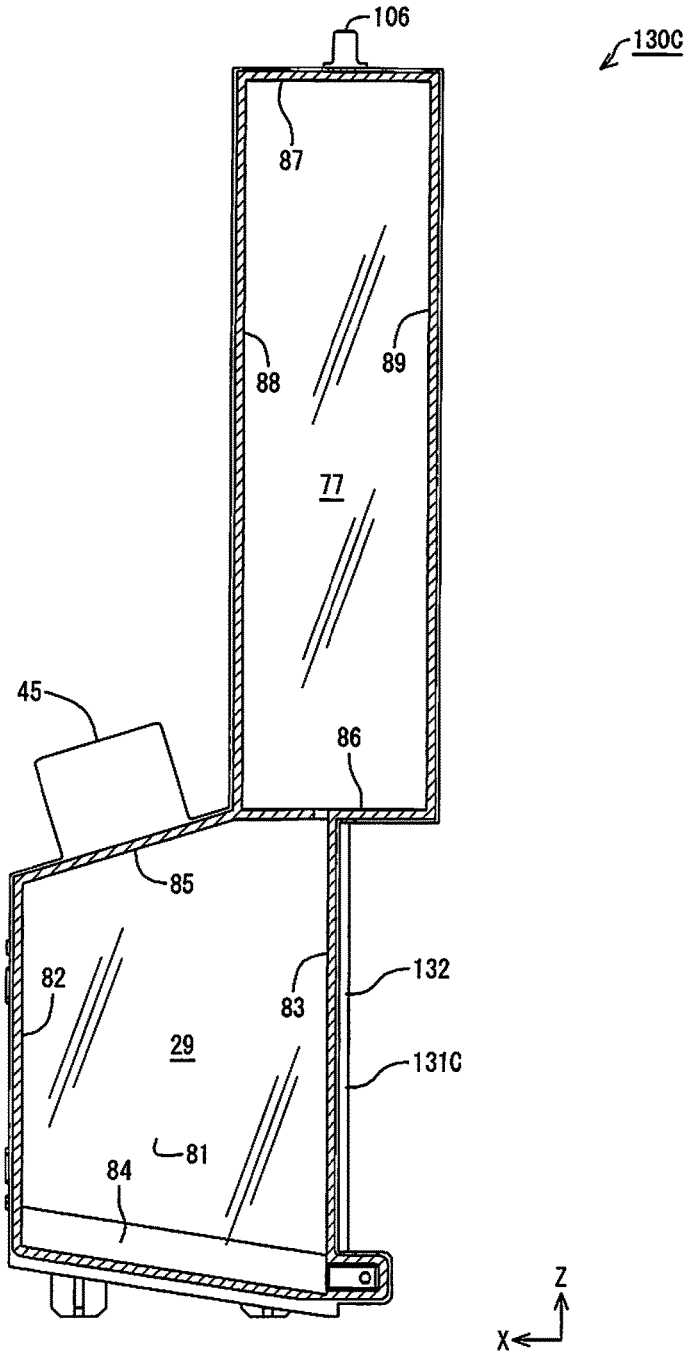
FIG. 15 is a cross-sectional view showing a tank in Modified Example 5.

As shown in FIG. 15, in a tank 130C of Modified Example 5, of the walls that demarcate the ink container portion 29, the partition 83 provides a low thermal conductance part 131C. The low thermal conductance part 131C includes a heat insulating member 132. The heat insulating member 132 is provided on a surface on an opposite side from the ink container portion 29 side of the partition 83. That is, the heat insulating member 132 is provided on an outer side of the ink container portion 29. The heat insulating member 132 is configured using a material having high heat insulation properties. Material that can be utilized to configure the heat insulating member 132 include for example urethane, phenol, polystyrene, glass fiber, and rock wool and the like. According to the low thermal conductance part 131C, which includes the heat insulating member 132 provided on the partition 83, the conveyance of heat from the heat sources to the ink within the ink container portions 29 can be kept lower. It should be noted that the wall on which the heat insulating member 132 is provided is not limited to the partition 83 and may be any wall that demarcates the ink container portion 29.

Modified Example 6

Figure 16:
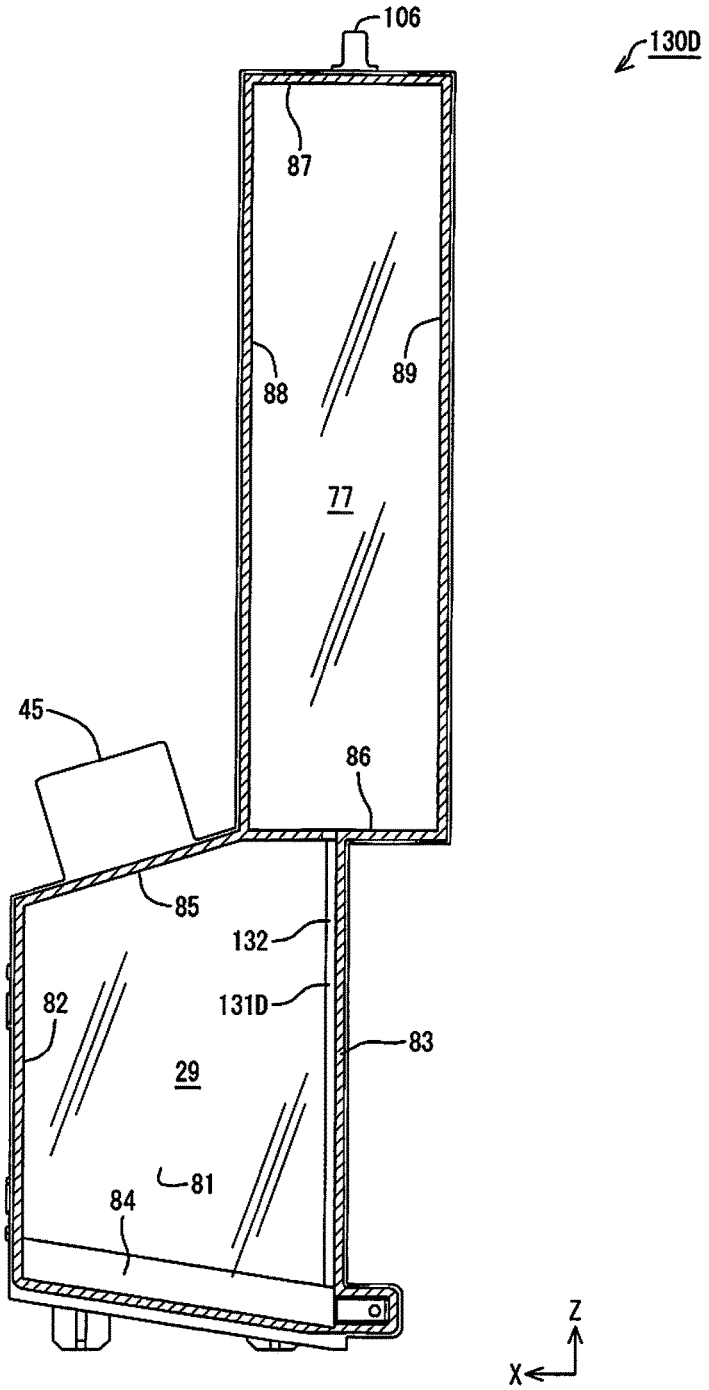
FIG. 16 is a cross-sectional view showing a tank in Modified Example 6.

As shown in FIG. 16, in a tank 130D of Modified Example 6, of the walls that demarcate the ink container portion 29, the partition 83 provides a low thermal conductance part 131D. The low thermal conductance part 131D includes a heat insulating member 132. The heat insulating member 132 is provided on a surface of the partition 83 facing the ink container portion 29. That is, the heat insulating member 132 is provided on an inner side of the ink container portion 29. As for materials by which the heat insulating member 132 is configured, the same materials as in Modified Example 5 may be utilized. According to the low thermal conductance part 131D, which includes the heat insulating member 132 provided on the partition 83, the conveyance of heat from the heat sources to the ink within the ink container portions 29 can be kept lower. It should be noted that the wall on which the heat insulating member 132 is provided is not limited to the partition 83 and may be any wall that demarcates the ink container portion 29.

Modified Example 7

Figure 17:
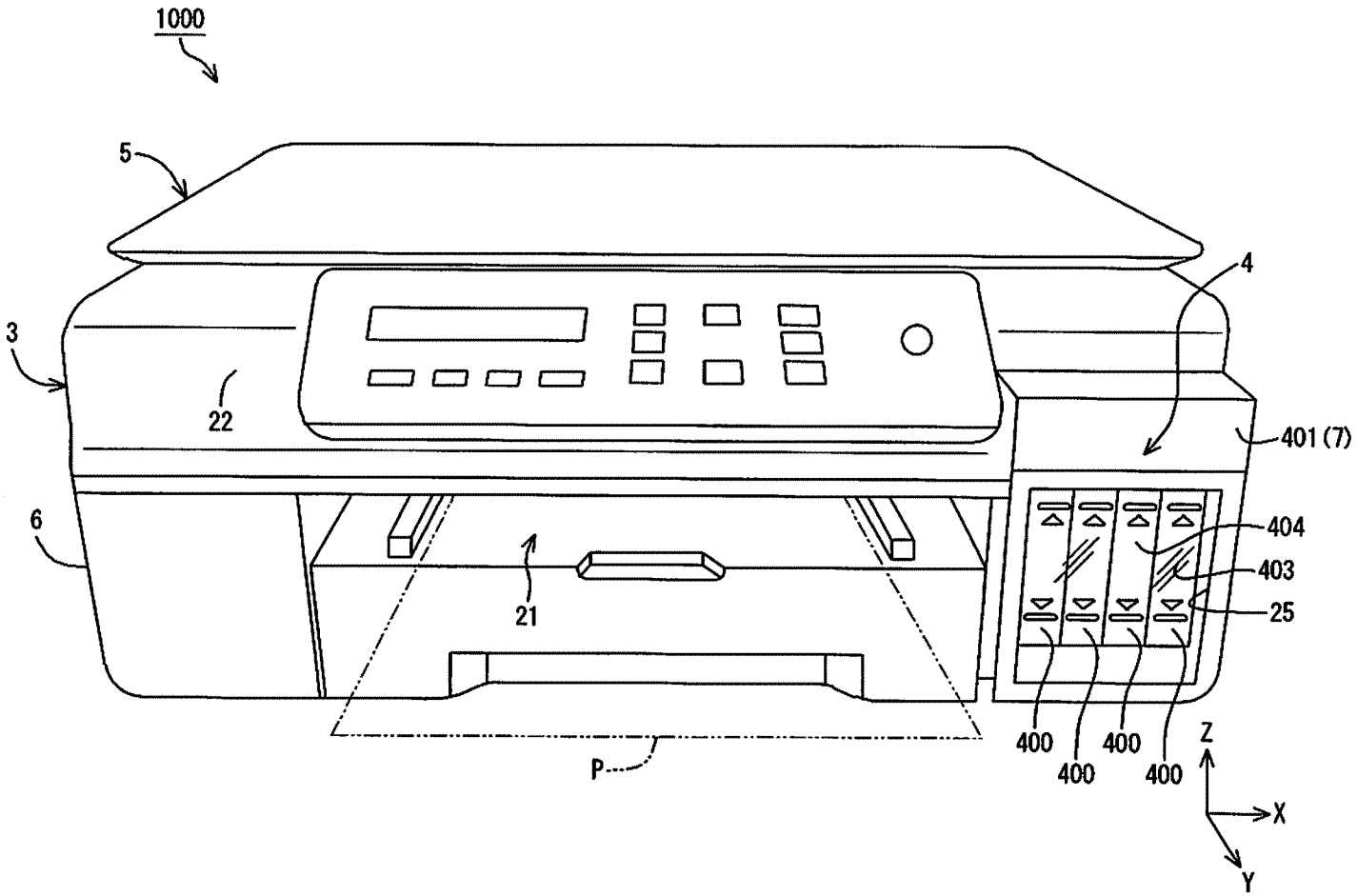
FIG. 17 is an external view showing one example of a printer according to Modified Example 7.

Description is given regarding a printer 1000 and a tank 400 of Modified Example 7. In the above-described printer 1, four tanks 10 are lined up along the Y axis. However the direction in which the multiple tanks are lined up is not limited to the Y axis. As shown in FIG. 17, in the printer 1000 of Modified Example 7, the multiple tanks 400 are lined up along the X axis. Description is given regarding forms of the printer 1000 and the tanks 400 of Modified Example 7. It should be noted that for the printer 1000 and the tanks 400, same configurations as in the printer 1 and the tanks 10 are assigned same symbols as for the printer 1 and the tanks 10, and detailed description thereof is omitted.

The printer 1000 has the printing unit 3, the tank unit 4, and the scanner unit 5. In the printer 1000, the tanks 400 are contained in the housing 6 of the printing unit 3. That is, in the printer 1000, the housing 7 (FIG. 1) of the printer 1 is integrally included in the housing 6. As shown in FIG. 17, in the printer 1000, the housing 6 has a cover 401. The cover 401 is configured to be capable of rotating with respect to the the housing 6. The cover 401 rotates so as to be capable of opening and closing with respect to the housing 6 centered on a rotational center (not shown in drawings) that extends along the X axis. That is, the cover 401 rotates toward the Y axis direction of the printer 1000.

As shown in FIG. 17, in the printer 1000, the multiple (four in this example) tanks 400 are contained inside the housing 6. The multiple tanks 400 in the printer 1000 are positioned on the front surface 22 side of the printer 1000, that is, on the Y axis direction side of the printer 1000. In the printer 1000, the multiple tanks 400 are arrayed along the X axis. For this reason, the X axis direction in the printer 1000 is the direction in which the multiple tanks 400 are arrayed.

A window unit 25 is provided on the cover 401. The window unit 25 is provided on the front surface 22 in the housing 6. The window unit 25 has optical transparency. And the tanks 400 are provided at positions overlapping the window unit 25. Thus, an operator using the printer 1000 can visually confirm the tanks 400 via the window unit 25. In the present embodiment, the window unit 25 is provided as an opening formed in the cover 401. And the window unit 25, which is provided as an opening, is blocked by a member 403 having optical transparency. Thus, the operator can visually confirm a visual confirmation wall 404 of the tanks 400 via the window unit 25, which is an opening. It should be noted that configurations may also be utilized that omit the member 403 that blocks the window unit 25. Even if the member 403 that blocks the window unit 25 is omitted, the operator can visually confirm the visual confirmation wall 404 of the tanks 400 via the window unit 25, which is an opening.

In the present embodiment, at least one area of the visual confirmation wall 404 of the tanks 400 has optical transparency. The ink inside the tanks 400 can be visually confirmed through a position of the visual confirmation wall 404 having optical transparency. That is, a liquid surface inside the tanks 400 can be visually confirmed through a position of the visual confirmation wall 404 having optical transparency. Accordingly, the operator is able to visually confirm the amount of ink in each of the tanks 400 by visually confirming the four tanks 400 via the window unit 25. That is, in the tanks 400, a position of the visual confirmation wall 404 having optical transparency can be utilized as a visual confirmation unit enabling visual confirmation of ink amounts. It should be noted that a configuration may also be utilized in which the entire visual confirmation wall 404 has optical transparency.

Figure 18:
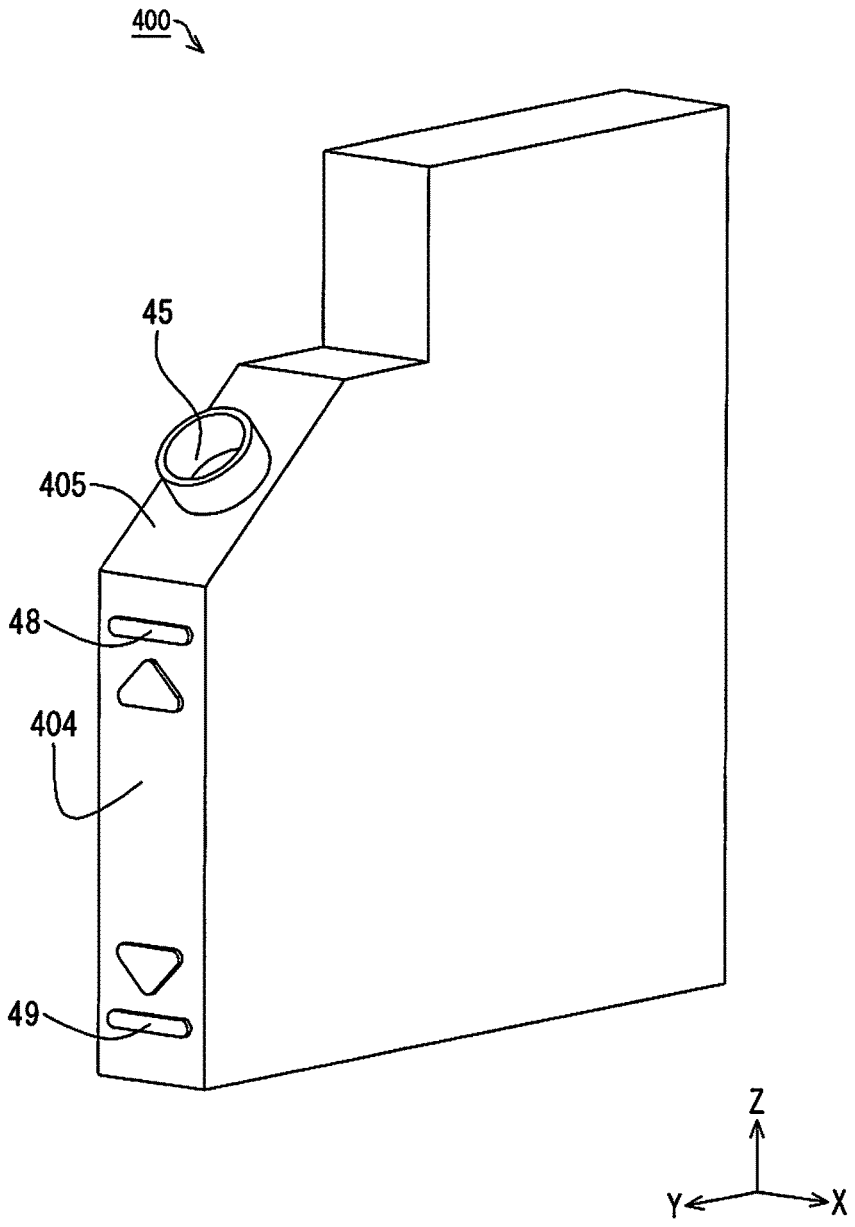
FIG. 18 is perspective view showing an example of a according to Modified Example 7.

As shown in FIG. 18, in the tanks 400 in the printer 1000, the inlet portion 45 is provided on a wall 405. In the usage position of the printer 1000, the wall 405 is tilted. The wall 405 is tilted in an orientation toward the −Y axis direction as moving in a direction from the −Z axis to the Z axis. Thus, the wall 405 faces in a direction that intersects the vertical direction. The aforementioned visual confirmation wall 404 extends in a direction intersecting the wall 405.

Figure 19:
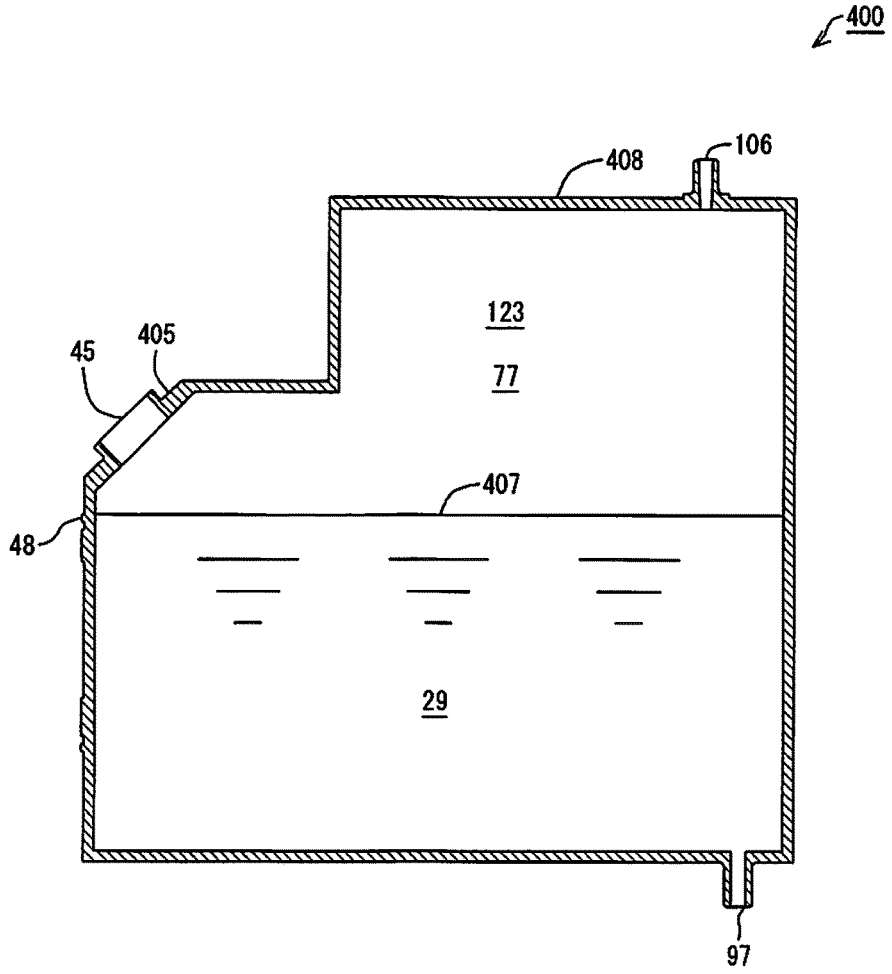
FIG. 19 is cross-sectional view showing a tank in Modified Example 7.

As shown in FIG. 19, in the tank 400 of Modified Example 7, a space is formed above an ink 407 in a state in which the ink 407 inside the ink container portion 29 has reached the upper limit mark 48. In the tank 400 of Modified Example 7, the space that is formed above the ink 407 is configured as the buffer chamber 77. And the open-atmosphere port 106 opens at the wall 408 that demarcates the buffer chamber 77.

The buffer chamber 77 can configure a space formation unit 123 also in the tank 400 of Modified Example 7. In the tank 400 of Modified Example 7, the ink container portion 29 and the space formation unit 123 are lined up along the Z axis, which is the vertical direction of the printer 1000. That is, in Modified Example 7, the ink container portion 29, the space formation unit 123, which is one example of a low thermal conductance part 131, and a heat source 129 can be readily arranged in the vertical direction. In Modified Example 7 also, according to the configuration in which the space formation unit 123 is arranged between the heat source 129 and the ink container portion 29, the conveyance of heat from the heat source 129 to the ink within the ink container portions 29 can be kept low.

Modified Example 8

Figure 20:
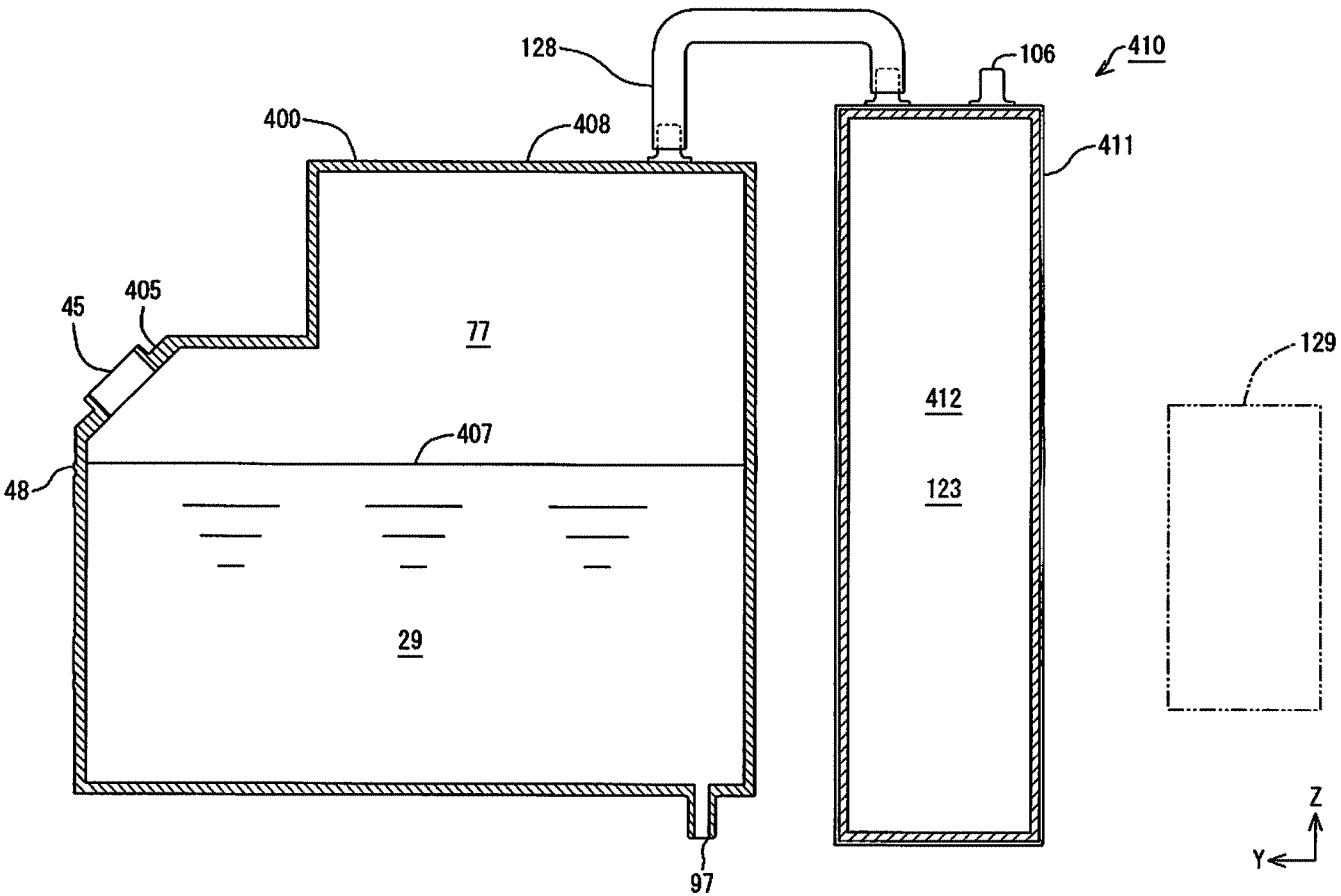
FIG. 20 is a diagram for describing schematically a configuration of a tank set in Modified Example 8.

Description is given regarding a tank set 410 of Modified Example 8. As shown in FIG. 20, the tank set 410 has a configuration in which a buffer unit 411 has been added to the tank 400. In Modified Example 8, same symbols as Modified Example 7 are assigned to configurations that are identical in Modified Example 7 and detailed description thereof is omitted.

In the tank set 410 of Modified Example 8, the tank 400 and the buffer unit 411 communicate by way of a tube 128 such as a tube having flexibility. The buffer unit 411 has a container shaped atmosphere containing unit 412 that is capable of containing atmosphere. The ink container portion 29 of the tank 400 and the buffer unit 411 communicate via the tube 128. As long as the tube 128 is configured by a flexible tube or the like, a high degree of freedom can be achieved for the positioning of the buffer unit 411, and therefore greater compactness of the printer 1000 can be more readily achieved.

Also in a printer 1000 that utilizes the tank set 410, by positioning the buffer unit 411 between the heat source 129 and the ink container portion 29, the buffer unit 411 can become the space formation unit 123, which is one example of the low thermal conductance part 131. In Modified Example 8, according to the configuration in which the space formation unit 123, which is one example of the low thermal conductance part 131, is arranged between the heat source 129 and the ink container portion 29, the conveyance of heat from the heat source 129 to the ink within the ink container portions 29 can be kept even further lower.

Furthermore, in the tank set 410 of Modified Example 8, the tank 400 and the buffer unit 411 are lined up along the Y axis, which is the front-back direction of the printer 1000. That is, in Modified Example 8, the ink container portion 29, the space formation unit 123, which is one example of the low thermal conductance part 131, and the heat source 129 can be arranged in the front-back direction. In the printer 1000, the heat sources 129 are often arranged at the rear surface side. For this reason, as in Modified Example 8, by arranging the ink container portion 29 at the front surface side and arranging the space formation unit 123, which is one example of the low thermal conductance part 131, between the ink container portion 29 and the heat sources 129, increases in size can be suppressed. Furthermore, in the tank set 410 of Modified Example 8, there is a high degree of freedom for the positioning of the space formation unit 123, and therefore arrangements are readily achieved in positions having an effective reduction in thermal conductance from positions between the heat source 129 and the ink container portion 29.

Modified Example 9

In the tank 400 of Modified Example 7, the ink container portion 29 and the space formation unit 123 are lined up in the vertical direction. However, configurations can also be utilized in which the ink container portion 29 and the space formation unit 123 are lined up in the front-back direction. Description is given of a configuration in which the ink container portion 29 and the space formation unit 123 are lined up in the front-back direction a a tank 413 of Modified Example 9. For the tank 413, same symbols as for the tank 400 are assigned to configurations that are identical in the tank 400 and detailed description thereof is omitted.

Figure 21:
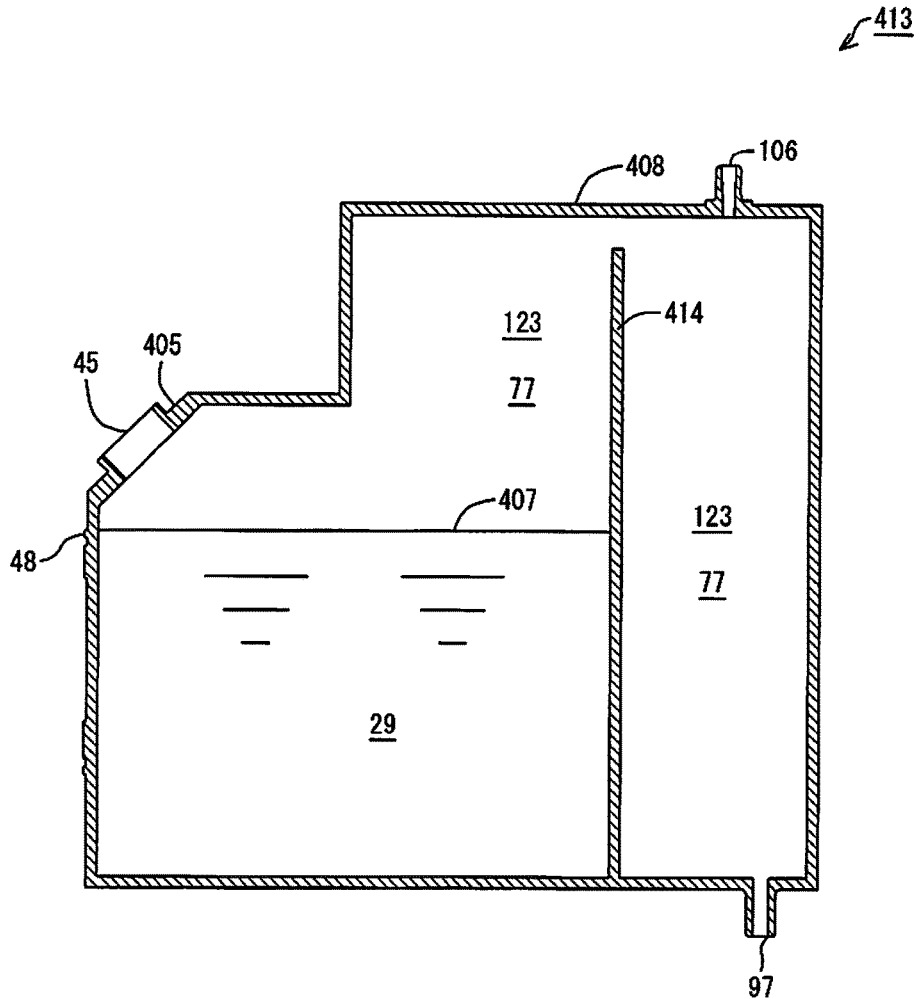
FIG. 21 is cross-sectional view showing a tank in Modified Example 9.

As shown in FIG. 21, a partition 414 is provided inside the tank 413. The partition 414 is one wall that demarcates the ink container portion 29. An area of the buffer chamber 77 is arranged at the rear of the ink container portion 29 separated by the partition 414. In comparison to the tank 400, in the tank 413 the buffer chamber 77 can be considered as a rearward extension of the ink container portion 29. According to the tank 413, the ink container portion 29 and the space formation unit 123 can be arranged in the vertical direction and in the front-back direction. Due to this, the space formation unit 123, which is one example of the low thermal conductance part 131, can be arranged between the ink container portion 29 and the heat sources 129 for both the vertical direction and the front-back direction. Thus, the conveyance of heat from the heat sources 129 to the ink within the ink container portions 29 can be kept even further lower.

It should be noted that configurations can also be utilized in which the above-described Modified Examples 1 to 6 are separately or compositely applied to the Modified Examples 7 to 9 respectively.

In each of the foregoing embodiments and each of the working examples, the liquid jetting device may be a liquid jetting device that consumes a liquid other than ink by discharging, ejecting, or applying that liquid. It should be noted that forms of liquid to be ejected as microscopic amounts of droplets from the liquid jetting device include grain shapes, tear shapes, and shapes that leave a thread-shape trail. Furthermore, the liquid referred to here may be any substance that can be consumed by the liquid jetting device. For example, it may be a substance in a state when a material is in a liquid phase, or a substance including flow-state substances such as a liquid substance having high or low viscosity, a sol or gel water or other inorganic solvent, an organic solvent, a solution, a liquid resin, or a liquid metal (molten metal). Furthermore, this is not only a liquid as a single state substance, but includes substances in which particles of a functional material constituted by a solid material such as a pigment or metal particles are melted, diffused or mixed into a solvent. In addition to the inks described in the foregoing embodiments, liquid crystals and the like can be set forth as representative examples of a liquid. Here, ink is inclusive of various types of liquid composites such as gel inks and hot melt inks and the like in addition to ordinary water-based inks and oil-based inks. Further still, sublimation transfer inks can be used as the ink. A sublimation transfer ink is an ink that includes a sublimation color material such as a sublimation dye for example. A printing method involves discharging such a sublimation transfer ink onto a transfer medium using the liquid jetting device, then bringing the transfer medium into contact with the matter to be printed and applying heat such that the color material is sublimated onto the matter to be printed. Matter to be printed includes T-shirts and smartphones and the like. In this way, using an ink that includes a sublimation color material, printing can be carried out on a wide range of matter to be printed (printing media). A specific example of a liquid jetting device is a liquid jetting device that discharges a liquid including an electrode material used in the manufacturing of liquid crystal displays, EL (electroluminescent) displays, and surface emitting displays, or a substance such as a color material or the like in the form of a diffusion or a dissolution. Furthermore, other examples include a liquid jetting device that discharges a biological material to be used in the manufacturing of biochips, a liquid jetting device used as a high precision pipet that discharges a liquid as a specimen, a textile printing device, and a microdispenser or the like. Further examples include a liquid jetting device that discharges a lubricant in a pinpoint manner to precision machinery such as watches or cameras or the like, and a liquid jetting device that discharges a transparent resinous liquid such as UV-cured resins onto a substrate in order to form a microscopic hemispherical lens (optical lens) or the like to be used in optical communication devices or the like. A further example is a liquid jetting device that discharges an acidic or alkaline etching liquid for etching a substrate or the like.

It should be noted that the invention is not limited to the aforementioned embodiments and working examples and can be achieved in various configurations within a scope that does not depart from the purport thereof. For example, technical features in the embodiments and working examples corresponding to technical features in the embodiments stated in the summary section can be substituted or combined as appropriate to solve some or all of the above-mentioned issues or to achieve some or all of the above-mentioned effects. Furthermore, as long as a technical feature is not described as an essential component in the description of the invention, it may be omitted as appropriate.

What is claimed is:

1. A printer, comprising:

a printhead configured to execute printing on a printing medium by jetting an ink onto the printing medium, a tank including an ink container portion configured to contain the ink to be supplied to the printhead, and a heat source, wherein a low thermal conductance section that reduces thermal conductance is positioned between the heat source and the ink container portion, and wherein the low thermal conductance part is a space formation unit that defines a space.

2. A printer according to claim 1, wherein the space formation unit is provided outside the tank.

3. A printer according to claim 1, wherein the space formation unit is provided inside the tank.

4. A printer according to claim 1, wherein an ink flow channel when ink inside the ink container portion is supplied to the printhead passes through the space formation unit.

5. A printer according to claim 1, wherein when the printer is viewed from a front surface in a usage position of the printer, the ink container portion and the space formation unit are arranged within a rectangular region, the heat source is positioned outside the rectangular region and positioned further upward than the ink container portion, the space formation unit is positioned above the ink container portion, an ink inlet portion, through which the ink is injected into the ink container portion, is formed in the ink container portion, and the ink inlet portion is formed in an upper portion of the ink container portion and positioned on an opposite side of the heat source side from the space formation unit.

6. A printer according to claim 1, comprising:

an information display unit configured to display information, wherein the heat source is the information display unit.

7. A printer according to claim 1, wherein when viewing the printer from a planar view, the heat source, the low thermal conductance part, and the ink container portion are positioned in a left-right direction that intersects the front-back direction.

8. A printer according to claim 1, wherein when viewing the printer from a front surface in a usage position of the printer, the heat source, the low thermal conductance part, and the ink container portion are positioned in a vertical direction.

9. A printer, comprising:

a printhead configured to execute printing on a printing medium by jetting an ink onto the printing medium, a tank including an ink container portion configured to contain the ink to be supplied to the printhead, and a heat source, wherein a low thermal conductance section that reduces thermal conductance is positioned between the heat source and the ink container portion, and wherein a wall which defines the ink container portion provides the low thermal conductance part.

10. A printer according to claim 9, wherein the low thermal conductance part includes a heat insulating member.

11. A printer, comprising:

a printhead configured to execute printing on a printing medium by jetting an ink onto the printing medium, a tank including an ink container portion configured to contain the ink to be supplied to the printhead, and a heat source, wherein a low thermal conductance section that reduces thermal conductance is positioned between the heat source and the ink container portion, and wherein when viewing the printer from a planar view, the ink container portion, the low thermal conductance part, and the heat source are positioned in a front-back direction.

* * * * *